US007234549B2

(12) United States Patent
McDonough et al.

(10) Patent No.: US 7,234,549 B2
(45) Date of Patent: Jun. 26, 2007

(54) METHODS FOR EVALUATING CUTTING ARRANGEMENTS FOR DRILL BITS AND THEIR APPLICATION TO ROLLER CONE DRILL BIT DESIGNS

(75) Inventors: Scott D. McDonough, Houston, TX (US); Amardeep Singh, Houston, TX (US); Daniel W. Brietzke, Richmond, TX (US)

(73) Assignee: Smith International Inc.

( * ) Notice: Subject to any disclaimer, the term of this patent is extended or adjusted under 35 U.S.C. 154(b) by 236 days.

(21) Appl. No.: 10/853,869

(22) Filed: May 26, 2004

(65) Prior Publication Data

US 2004/0251053 A1 Dec. 16, 2004

Related U.S. Application Data

(60) Provisional application No. 60/473,552, filed on May 27, 2003.

(51) Int. Cl.
*E21B 10/16* (2006.01)

(52) U.S. Cl. ..... 175/378; 175/376

(58) Field of Classification Search ..... 175/378, 175/376, 398, 431

See application file for complete search history.

(56) References Cited

U.S. PATENT DOCUMENTS

| | | | | |
|---|---|---|---|---|
| 1,896,251 | A * | 2/1933 | Scott | 175/378 |
| 2,094,856 | A * | 10/1937 | Smith et al. | 175/364 |
| 3,326,307 | A * | 6/1967 | Rudy | 175/374 |
| 3,726,350 | A | 4/1973 | Pesaier | |
| 4,187,922 | A | 2/1980 | Phelps | |
| 4,248,314 | A | 2/1981 | Cunningham et al. | |
| 4,316,515 | A | 2/1982 | Pessier | |
| 4,441,566 | A | 4/1984 | Pessier et al. | |
| 5,224,560 | A | 7/1993 | Fernandez | |
| 5,605,198 | A | 2/1997 | Tibbitts | |
| 5,839,526 | A | 11/1998 | Cisneros et al. | |
| 6,151,960 | A | 11/2000 | Taylor | |
| 6,209,668 | B1 | 4/2001 | Pessier et al. | |
| 6,879,947 | B1 | 4/2005 | Glass | |
| 2001/0020551 | A1 | 9/2001 | Taylor | |
| 2005/0167161 | A1 * | 8/2005 | Aaron et al. | 175/331 |

* cited by examiner

*Primary Examiner*—Kenneth Thompson

(57) ABSTRACT

A method for evaluating a cutting arrangement for a drill bit includes selecting a cutting element arrangement for the drill bit and calculating a score for the cutting arrangement. This method may be used to evaluate the cutting efficiency of various drill bit designs. In one example, this method is used to calculate a score for an arrangement based on a comparison of an expected bottomhole pattern for the arrangement with a preferred bottomhole pattern. The use of this method has lead to roller cone drill bit designs that exhibit reduce tracking over prior art bits.

35 Claims, 14 Drawing Sheets

CRATERS

| PATTERN | EPVETCH |
|---|---|
| | 36.00 |
| | 36.00 |
| | 36.00 |
| | 36.00 |
| | 36.00 |
| | 36.00 |
| | 36.00 |
| | 36.00 |
| | 36.00 |
| | 36.00 |

605

CLICK CELL WITH RATIO OF CONCERN TO VIEW CRATER FOR PATTERN "A"

| 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|
| 1.150 | 1.159 | 1.168 | 1.176 | 1.185 | 1.194 | 1.203 | 1.211 | 1.220 | 1.229 | 1.238 | 1.246 | 1.255 | 1.264 | 1.273 | 1.281 | 1.290 | 1.299 | 1.308 | 1.316 |
| **21** | **22** | **23** | **24** | **25** | **26** | **27** | **28** | **29** | **30** | **31** | **32** | **33** | **34** | **35** | **36** | **37** | **38** | **39** | **40** | **41** |
| 1.325 | 1.334 | 1.343 | 1.351 | 1.360 | 1.369 | 1.378 | 1.386 | 1.395 | 1.404 | 1.413 | 1.421 | 1.430 | 1.439 | 1.448 | 1.456 | 1.465 | 1.474 | 1.483 | 1.491 | 1.500 |

603

| # OF REVS | PATTERN A (725) | PATTERN B (703) | PATTERN C (705) | PATTERN D (707) | PATTERN E (709) (701) |
|---|---|---|---|---|---|
| 3 | 30.00 | 32.00 | 30.00 | 40.00 | 36.00 |
| | 40.00 | 32.00 | 30.00 | 32.00 | 36.00 |
| | 30.00 | 32.00 | 50.00 | 40.00 | 36.00 |
| | 40.00 | 32.00 | 30.00 | 32.00 | 36.00 |
| | 30.00 | 40.00 | 30.00 | 40.00 | 36.00 |
| | 40.00 | 40.00 | 50.00 | 32.00 | 36.00 |
| | 30.00 | 40.00 | 30.00 | 40.00 | 36.00 |
| | 40.00 | 40.00 | 30.00 | 32.00 | 36.00 |
| | 30.00 | 40.00 | 50.00 | 40.00 | 36.00 |
| | 50.00 | 32.00 | 30.00 | 32.00 | 36.00 |
| 721 HI TOLERANCE | | 0.25 | | | EVEN PITCH |
| 717 HI 25% | | 0.05 | | | |
| 713 MEDIAN RATIO | | 1.25 | | | |
| 715 LOW 25% | | 0.03 | 1.220 | | |
| 719 LOW TOLERANCE | | 0.1 | | | |

| | | | CLICK CELL WITH RATIO OF CONCERN TO VIEW CRATER FOR PATTERN "A" | | | | | | | | | | | | | | | | | |
|---|---|---|---|---|---|---|---|---|---|---|---|---|---|---|---|---|---|---|---|---|
| 1 | 2 | 3 | 4 | 5 | 6 | 7 | 8 | 9 | 10 | 11 | 12 | 13 | 14 | 15 | 16 | 17 | 18 | 19 | 20 | |
| 1.150 | 1.159 | 1.168 | 1.176 | 1.185 | 1.194 | 1.203 | 1.211 | 1.220 | 1.229 | 1.238 | 1.246 | 1.255 | 1.264 | 1.273 | 1.281 | 1.290 | 1.299 | 1.308 | 1.316 | |
| 21 | 22 | 23 | 24 | 25 | 26 | 27 | 28 | 29 | 30 | 31 | 32 | 33 | 34 | 35 | 36 | 37 | 38 | 39 | 40 | 41 |
| 1.325 | 1.334 | 1.343 | 1.351 | 1.360 | 1.369 | 1.378 | 1.386 | 1.395 | 1.404 | 1.413 | 1.421 | 1.430 | 1.439 | 1.448 | 1.456 | 1.465 | 1.474 | 1.483 | 1.491 | 1.500 |

723

METHODS FOR EVALUATING CUTTING ARRANGEMENTS FOR DRILL BITS AND THEIR APPLICATION TO ROLLER CONE DRILL BIT DESIGNS

CROSS-REFERENCE TO RELATED APPLICATIONS

This application claims the benefit under 35 U.S.C. §119 (e) of U.S. Provisional Patent Application No. 60/473,552, filed on May 27, 2003, titled "Methods for Designing, Evaluating, and Optimizing, Cutting Arrangements for Drill Bits and Their Application to Roller Cone Drill Bit Designs," and now incorporated by reference.

STATEMENT REGARDING FEDERALLY SPONSORED RESEARCH OR DEVELOPMENT

Not applicable.

COPYRIGHT OR MASK WORK NOTICE

A portion of the disclosure of this patent document contains material which is subject to (copyright or mask work) protection. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

BACKGROUND OF INVENTION

1. Field of the Invention

The invention relates generally to drill bits for drilling boreholes in subsurface formations. More particularly, the invention relates to methods for designing drill bits, methods for evaluating cutting structures for drill bits, and methods for optimizing a cutting arrangement for a drill bit. The invention also provides a novel method that can be used to calculate scores for cutting arrangements proposed for drill bits.

2. Background Art

FIG. 1 shows one example of a conventional drilling system used in the oil and gas industry for drilling wells in earth formations. The drilling system includes a drilling rig 10 used to turn a drill string 12 which extends downward into a well bore 14. Connected to the end of the drill string 12 is a drill bit 20. The drill bit 20 is designed to break up and gouge earth formations 16 when rotated on the formations. 16 under an applied force. Formation 16 broken up by the drill bit 20 during drilling is removed from the well bore 14 by drilling fluid typically pumped through the drill string 12 and drill bit 10 and up the annulus between the drill string 12 and the well bore 14.

One example of a conventional drill bit is shown in FIG. 2. This type of drill bit is typically referred to as a roller cone drill bit. The drill bit 20 includes a bit body 22 having a threaded section 24 at its upper end for securing to the drill string (12 in FIG. 1) and a plurality of legs 25 extending downwardly at its lower end. A frustro-conical rolling cone cutter (hereafter referred to as roller cone 26) is rotatably mounted on each leg 25 by a bearing shaft pin which extends downwardly and inwardly from each leg 25. Each of the roller cones 26 has a cutting structure comprising a plurality of cutting elements 28 arranged on the conical surface of the cones 26. The cutting elements 28 project from the cone body and act to break up earth formations at the bottom of the borehole when the bit 20 is rotated under an applied axial load. The cutting elements 28 may comprise teeth formed on the conical surface of the cone 26 (typically referred to as milled steel teeth) or inserts press-fitted into holes in the conical surface of the cone 26 (such as tungsten carbide inserts or polycrystalline diamond compacts).

Many prior art roller cone drill bits have been found to provide poor drilling performance due to problems such as "tracking" and "slipping." Tracking occurs when cutting elements on a drill bit fall into previous impressions formed in the formation by cutting elements at a preceding moment in time during revolution of the drill bit. Slipping is related to tracking and occurs when cutting elements strike a portion of previous impressions and slides into the previous impressions.

In the case of roller cone drill bits, the cones of the bit typically do not exhibit true rolling during drilling due to action on the bottom of the borehole (hereafter referred to as "the bottomhole"), such as slipping. Because cutting elements do not cut effectively when they fall or slide into previous impressions made by other cutting elements, tracking and slipping should be avoided. In particular, tracking is inefficient since there is no fresh rock cut, and thus a waste of energy. Ideally every hit on a bottomhole cuts fresh rock. Additionally, slipping should also be avoided because it can result in uneven wear on the cutting elements which can result in premature failure. It has been found that tracking and slipping often occur due to a less than optimum spacing of cutting elements on the bit. In many cases, by making proper adjustments to the arrangement of cutting elements on a bit, problems such as tracking and slipping can be significantly reduced. This is especially true for cutting elements on a drive row of a cone on a roller cone drill bit because the drive row is the row that generally governs the rotation speed of the cones.

Currently, cutting arrangements, such as the arrangement of cutting elements on rows of a roller cone drill bit are designed either by gut feel, in reaction to field performance, such as the addition of odd pitches to alleviate tracking and slipping, or by trial and error in conjunction with other programs used to predict drilling performance. The problem in these design approaches is that the resulting arrangements are often arrived at somewhat arbitrarily, which can be time consuming in the evolution of the bit design and may or may not lead to drill bits producing desired drilling characteristics.

Therefore, methods for predicting drilling characteristics prior to the manufacturing of drill bits are desired to reduce costs associated with designing bits and to enhance the development of longer lasting bits and/or bits which more aggressively drill through earth formations. Methods are also desired to minimize or eliminate the design and manufacturing of ineffective drill bits which exhibit significant tracking or slipping problems during drilling. Methods are also desired to reduce the time required for designing effective drill bits. Additionally, drill bit designs that exhibit reduced tracking and slipping over prior art bit designs are also desired.

SUMMARY OF INVENTION

The invention generally relates to drill bits for drilling boreholes in earth formations. In one aspect, the invention provides methods for evaluating cutting arrangements for drill bits, methods for designing drill bits, and methods for optimizing a cutting arrangement for a drill bit. In another aspect, the invention provides new cutting arrangements for roller cone drill bits.

In one or more embodiments, a method for evaluating a cutting arrangement for a drill bit includes selecting a cutting element arrangement for the drill bit and calculating a score for the cutting element arrangement.

In one or more embodiments, a method for designing a drill bit includes selecting an arrangement of cutting elements for the drill bit. The arrangement includes at least a number of cutting elements and spaces between the cutting elements. The method also includes calculating a score for the arrangement based on the number of cutting elements and the spaces between cutting elements.

In one or more embodiments, a method for optimizing a cutting arrangement for a drill bit includes selecting an arrangement of cutting elements for the drill bit, calculating a score for the arrangement, adjusting at least one parameter of the arrangement and calculating a score for the adjusted arrangement. The adjusting of the arrangement and the calculating of a score for the adjusted arrangement are repeated until a desired score is obtained. In one or more embodiments, the adjusting and the calculating a score are repeated for each of a number of arrangements and an optimized arrangement is determined as the arrangement having the most favorable score.

In one or more embodiments, a method for optimizing a cutting arrangement for a drill bit includes: (a) selecting an arrangement of cutting elements for the drill bit, (b) determining a bottomhole hit pattern for the arrangement, and (c) comparing the bottomhole hit pattern to a preferred hit pattern. The method also includes: (d) adjusting at least one parameter of the arrangement, and (e) repeating steps (b) through (d) until a preferred arrangement having a bottomhole hit pattern similar to the preferred hit pattern is obtained.

In one or more embodiments, a method for evaluating a cutting efficiency of a roller cone drill bit in drilling on a bottomhole includes selecting an arrangement of cutting elements on at least one cone of the roller cone drill bit. The arrangement includes at least a number of cutting elements and spaces between the cutting elements. The method also includes selecting evaluation parameters including at least a number of revolutions of the bit to be considered, and selecting a cone to bit rotation ratio. The method further includes determining for the arrangement, actual locations for hits of the cutting elements on the bottomhole when the roller cone drill bit is rotated by the number of revolutions on the bottomhole. The actual locations are determined based on the number of cutting elements, the spaces between cutting elements, and the rotation ratio. The method further includes calculating preferred locations for hits on the bottomhole based on the number of actual locations of hits made on the bottomhole. The method also includes calculating a score for the arrangement based on a comparison between the actual locations and the preferred locations.

In one or more embodiments, a roller cone drill bit in accordance with an aspect of the invention includes a plurality of roller cones adapted to roll on a bottomhole surface and a plurality of cutting elements generally arranged in a row on at least one of the roller cones. The plurality of cutting elements are arranged with spaces in between them such that a first group of contiguous spaces, which includes at least three spaces, are all substantially equal in measurement to one another, and a second group of different contiguous spaces, which include at least two spaces, are all substantially equal in measurement to each other and are substantially different in measurement than the spaces in the first group.

Other aspects and advantages of the invention will be apparent from the following description and the appended claims.

DETAILED DESCRIPTION

The present invention relates to drill bits for drilling bore holes through earth formations. More particularly, the present invention provides a method for scoring a drill bit, a method for evaluating a cutting arrangement for a drill bit, a method for designing a drill bit, and a method for optimizing a cutting arrangement for a drill bit. In another aspect, the invention provides an improved cutting arrangement for a roller cone drill bit.

Figure 7:
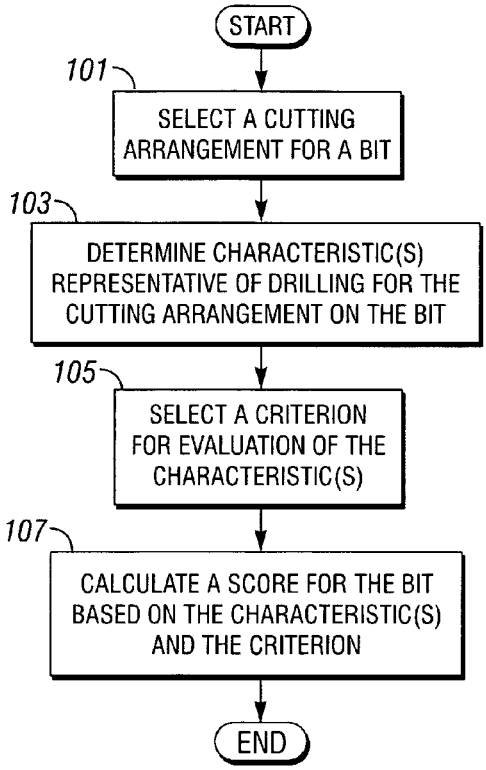
FIG. 7 shows a flow chart of a method in accordance with one embodiment of the invention that may be used to evaluate a quality of a cutting arrangement for a drill bit.

A flow chart showing one example of a method for scoring a drill bit in accordance with the present invention is shown in FIG. 7. This method may also be adapted and used to evaluate a cutting arrangement for a drill bit or to optimize a cutting arrangement on a drill bit. The method includes selecting a cutting arrangement for a drill bit 101 and determining at least one characteristic representative of drilling for the cutting arrangement on the drill bit 103. The method also includes selecting a criterion for evaluating the at least one characteristic 105, and calculating a score for the arrangement based on the at least one characteristic and the criterion 107.

In one or more embodiments, the method may additionally include adjusting at least one parameter of the cutting arrangement, repeating the determining of the at least one characteristic, but this time for the adjusted arrangement, and calculating a score for the adjusted arrangement. These additional steps can be repeated a selected number of times to obtain a plurality of scores corresponding to a plurality of different arrangements. A preferred arrangement for the drill bit can then be selected from the plurality of different arrangements based on a comparison of the scores for the different arrangements. Preferably, the arrangement having the most favorable score or a combination of a favorable score and more favorable additional characteristics (i.e., more favorable arrangement characteristics, more favorable drilling characteristics, etc.) is selected as the arrangement for the drill bit. More favorable arrangement characteristics may include things such as a more preferable spacing between cutting elements, for example such that that gaps too large or too small do not exist between cutting elements in the arrangement, or cutting element arrangements that are more easily manufacturable. More favorable drilling characteristics may include a higher rate of penetration, a more stable dynamic response during drilling, etc.

Examples related to this aspect of the invention are further developed below. In the examples below, the selected characteristic representative of drilling is the bottomhole pattern produced by the selected cutting arrangement. The selected criterion for evaluating the cutting element arrangement is a preferred bottomhole pattern. Those skilled in the art will appreciate that in view of the above description and the examples below, other characteristics and criterion may be selected and used for other embodiments of the invention. For example, the selected criterion may be a preferred value for a drilling parameter, such as a preferred rate of penetration, weight on bit, axial force response, lateral vibration response, or other characteristic representative of drilling that can be adjusted or altered by altering a parameter of a cutting arrangement.

For one or more embodiments of the invention, methods, such as the methods disclosed in U.S. Pat. No. 6,516,293 and U.S. application Ser. No. 09/689,299, which are assigned to the assignee of the present invention and incorporated herein by reference, may be used in determining the characteristic representative of drilling for the drill bit, or a drilling tool assembly including the drill bit, having the selected cutting arrangement.

The examples developed in detail below are described with reference to a roller cone drill bit, similar to the one shown in FIG. 2. However, those skilled in the art will appreciate that in view of this disclosure, similar methods may be developed for fixed cutter bits, which do not depart from the spirit of the invention.

Figure 2:
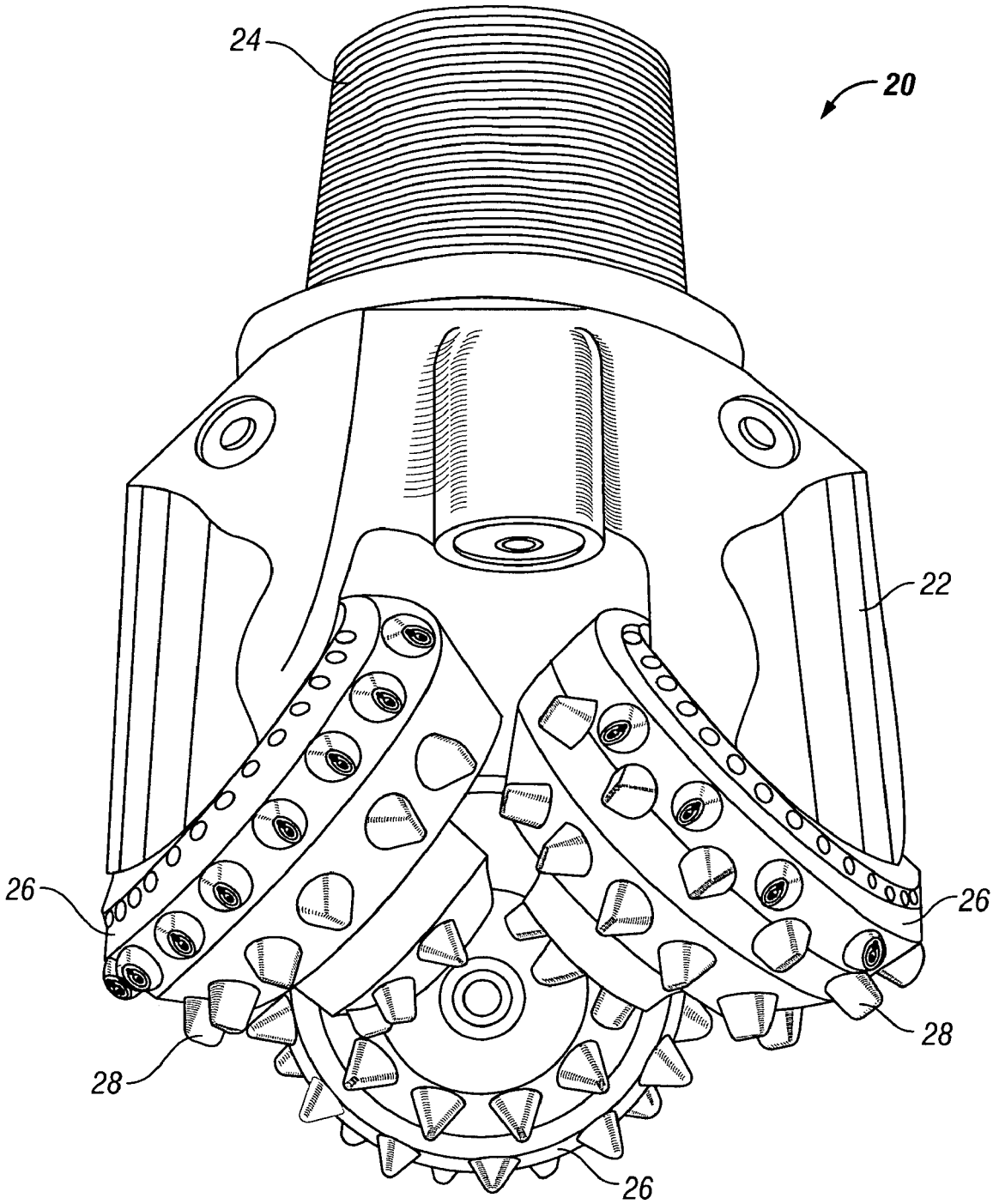
FIG. 2 (Prior Art)
FIG. 2 shows a perspective view of a conventional roller cone drill bit.

Referring to FIG. 2, the roller cone drill bit 20 includes a bit body 22 having a plurality of legs 25 that extend from one end. Rotatably mounted on each leg is a roller cone 26 having a plurality of cutting elements 28 disposed thereon for cutting through earth formations as the cone 26 is rotated along a bottomhole of a well bore.

Figure 3:
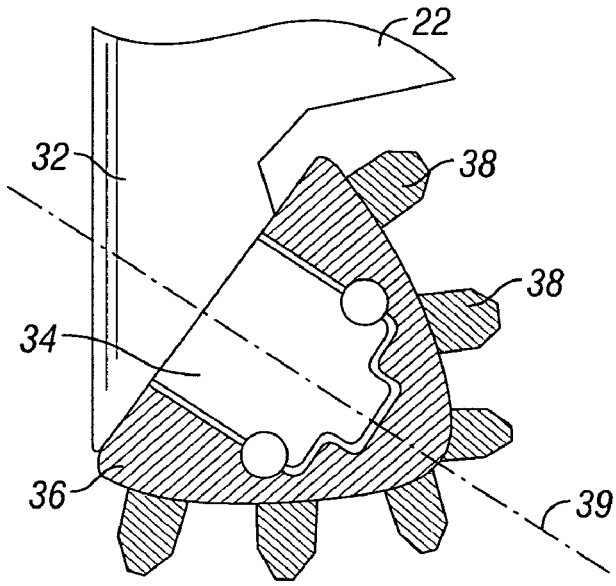
FIG. 3 shows a partial cross sectional view of one leg of a roller cone drill bit with a roller cone mounted thereon.

A partial cross section view of one leg of a roller cone drill bit is shown in FIG. 3. The leg 32 extends downward from the main portion of the bit body 22 and includes a bearing shaft pin 34 which extends downward and inwardly with respect to the bit body 22. The roller cone 36 is rotatably mounted on the bearing shaft pin 34. The cutting elements 38 disposed on the conical surface of the cone 36 in generally arranged in three circumferential rows which are axially spaced apart with respect to the cone axis 39. Typically each of the rows of cutting elements 38 on one cone are axially offset from rows of cutting elements arranged on the other cones (not shown) to provide an intermeshing of cutting elements between the cones. Intermeshing cutting element arrangements are desired to permit high insert protrusion to achieve competitive rates of penetration while preserving the longevity of the bit.

Figure 4:
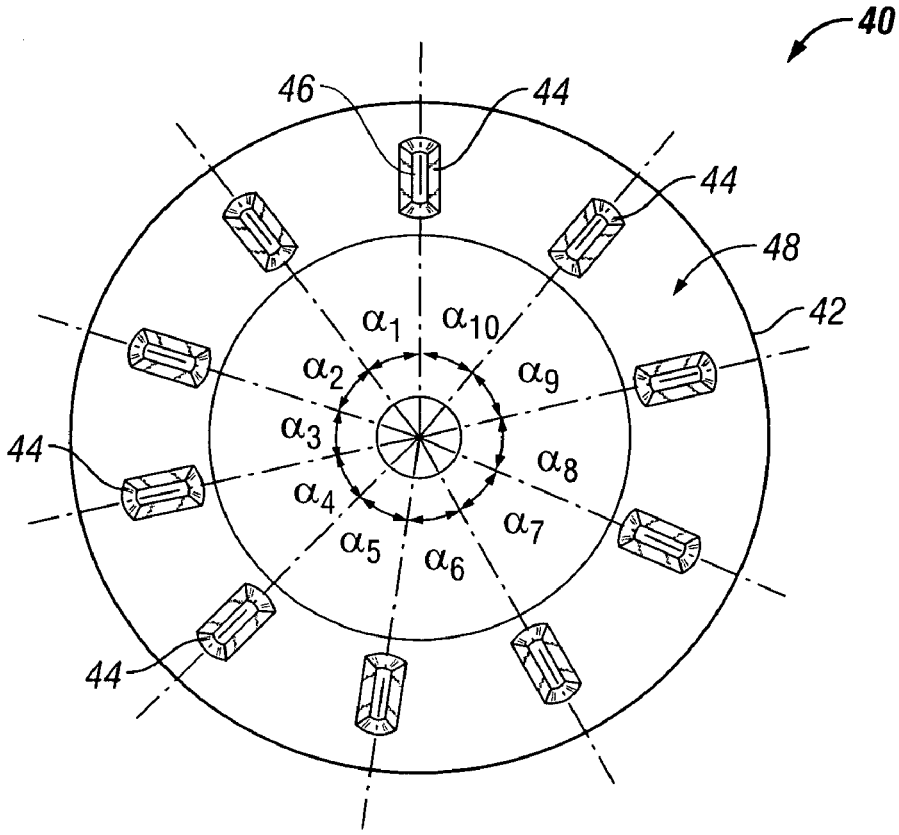
FIG. 4 shows a schematic layout illustrating a cutting element spacing arrangement for a row on a roller cone of a drill bit.

In general, cutting element arrangements for drill bits can be generally defined by the location of each cutting element in the arrangement. The location of each cutting element may be expressed with respect to a bit coordinate system or a cone coordinate system, depending-on the type of drill bit being considered. In some cases, such as for drill bits having cutting elements generally arranged in rows, the cutting element arrangements may be even more simply defined by the "pitch" (or spacing) between cutting elements in a row on the face of a roller cone or bit body and the radial location of the row on the cone or bit. In these cases, the pitch may be defined as the straight line distance between centerlines at the tips of adjacent cutting elements, or, alternatively, may be expressed by an angular measurement between adjacent cutting elements in a generally circular row about the cone or bit axis, for a roller cone or fixed cutter bit, respectively. An example of this for a roller cone bit is shown in FIG. 4. This angular measurement is typically taken in a plane perpendicular to the cone axis. When the cutting elements are equally spaced in a row about the conical surface of a cone, the arrangement is referred to as having an "even pitch" (i.e., a pitch angle equal to 360° divided by the number of cutting elements).

Those skilled in the art will appreciate that, for clarity, simplified examples are presented herein and described below. In these examples, the cutting elements are described as generally arranged in rows with spaces between adjacent cutting elements being described in terms of pitch. It should be understood that the invention is not limited to these simplified arrangements. Rather, other embodiments of the invention may be adapted and used for other arrangements, such as multiple rows on a cone, a general arrangement on one or more cones, or an entire cutting arrangement for a drill bit.

Referring to FIG. 4, one example of a cutting element arrangement 40 proposed for a row 48 of a roller cone of a roller cone drill bit is shown. The arrangement includes ten cutting elements 44 spaced apart and arranged in a circular row 48 about the conical surface of the roller cone 42. In this case, the amount of spacing between each pair of adjacent cutting elements 44 is defined in terms of a pitch angle, $\alpha_i$. This type of spacing arrangement for a row of cutting elements on a roller cone of a roller cone drill bit is often referred to as a "spacing pattern" or a "pitch pattern" for a row.

Figure 5:
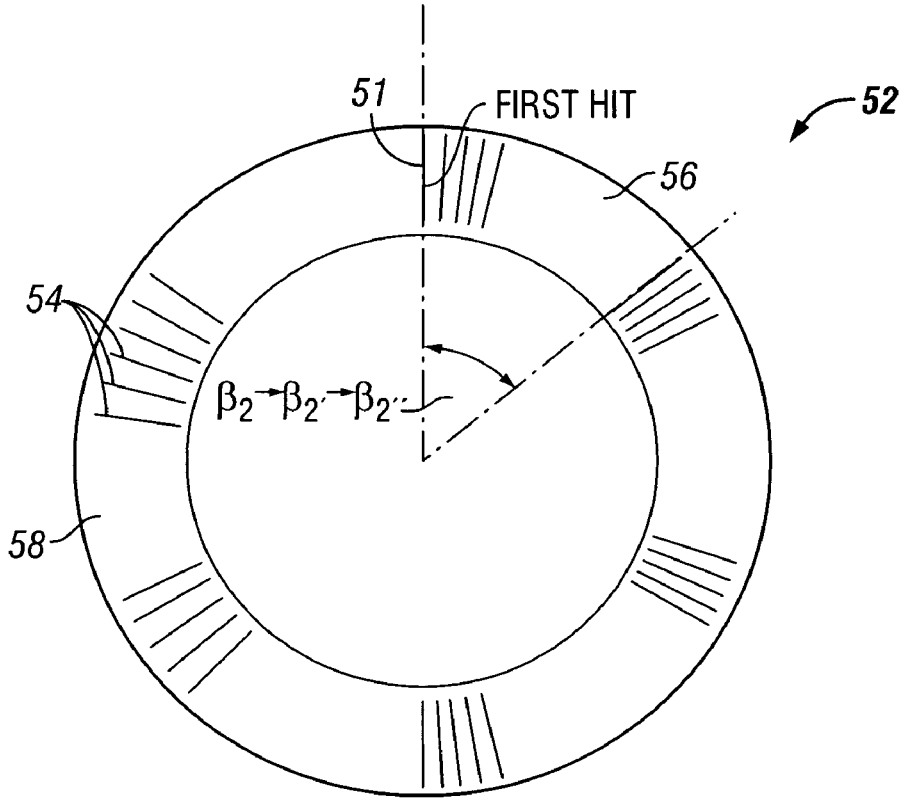
FIG. 5 shows a schematic layout illustrating a bottomhole hit pattern made by a cutting element arrangement for a row of a roller cone of a drill bit, similar to the arrangement in FIG. 4, during a number of revolutions of the bit.

One example of a pattern of impressions made on a hole bottom by cutting elements in a row on a roller cone of a roller cone drill bit (such as row 48 in FIG. 4) is shown in FIG. 5. In this example, each impression made by a cutting element that contacted the bottomhole during the rotation of the bit is referred to as a "hit." Although the actual impression made by a cutting element on a roller cone drill bit is more of an area of scrape and impact often resulting in the formation of a crater, in the example shown and discussed below, each impression will be simply represented by a hit located at the center of that area of scrape. The location of each hit on the bottomhole will be referred to as a "bottomhole hit location." The collection of hits made on the bottomhole during a selected number of revolutions of the bit will be referred to as a "bottomhole hit pattern."

The bottomhole hit pattern 52 shown in FIG. 5 includes a number of hits 54 made on the bottomhole 56 by cutting elements in one row on a roller cone of a roller cone drill bit (not shown) during a selected number of revolutions of the bit on the bottomhole 56. Most of the hits 54 in this example occurred in close proximity to other hits made which resulted in a bottomhole hit pattern 52 with wide gaps 58 of uncut formation separating clustered hits on the bottomhole 56.

The bottomhole hit pattern shown in FIG. 5 is typically considered undesirable because the hits occur in close proximity to previous hits with wide gaps of uncut formation remaining. This type of pattern typically signifies a high likelihood of tracking and slipping during drilling, especially if the arrangement producing the pattern is used in a drive row. This bottomhole hit pattern may also indicate a poor use of hits when the crater sizes corresponding to each hit are larger than the distances between the hits.

Figure 6:
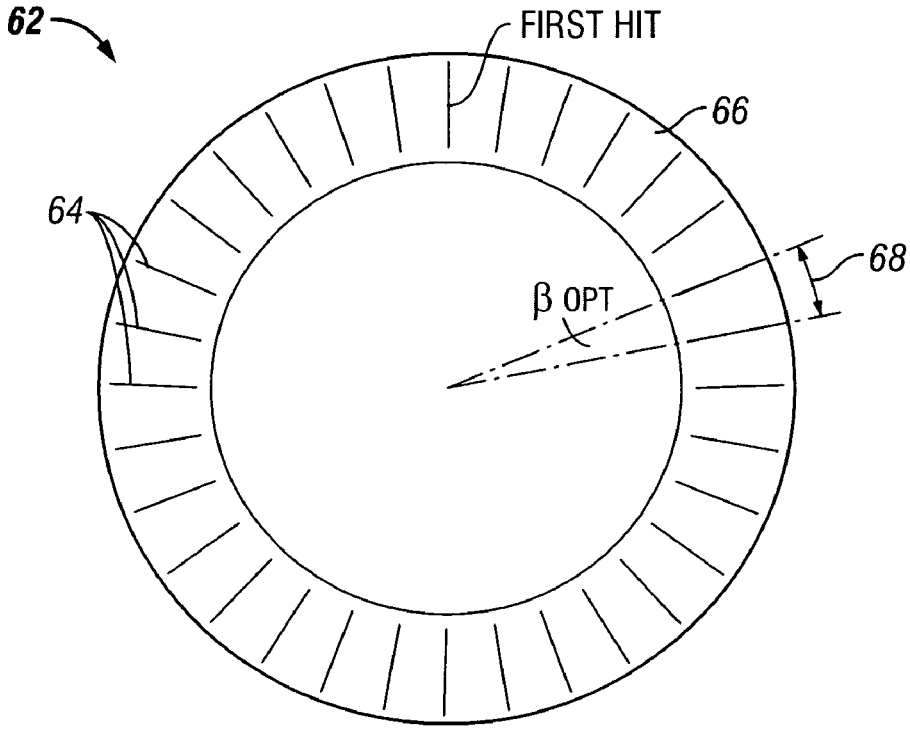
FIG. 6 shows a schematic layout illustrating a preferred bottomhole hit pattern in comparison to the bottomhole hit pattern shown in FIG. 5.

To minimize a potential for tracking and slipping and/or to improve a cutting efficiency of a cutting arrangement, an arrangement may be desired that results in a more even distribution of hits on the bottomhole during a selected number of revolutions of the drill bit. For example, a bottomhole hit pattern 62 as shown in FIG. 6 may be considered more preferable than the bottomhole hit pattern shown in FIG. 5 because this bottomhole hit pattern 62 includes a plurality of hits 64 that are substantially evenly spaced about the section of the bottomhole 66 cut by the cutting arrangement.

Figure 8:
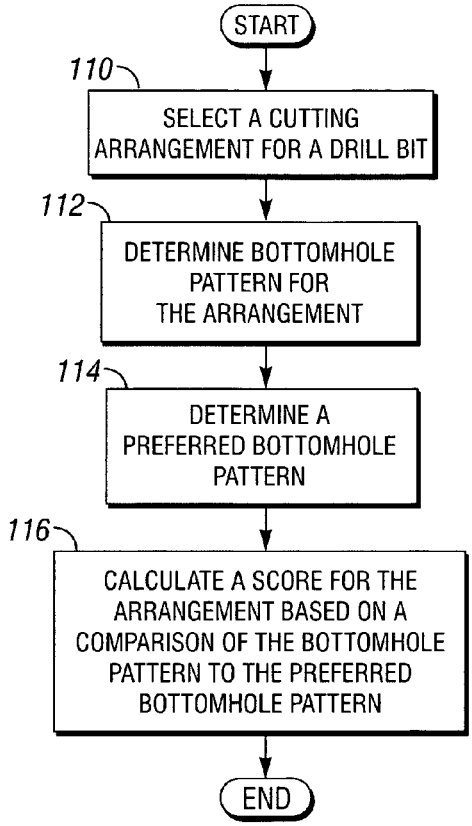
FIG. 8 shows a flow chart of a method in accordance with one embodiment of the invention that may be used to evaluate a quality of a cutting arrangement for a drill bit.

Referring to FIG. 8, in accordance with the aspect of the invention show in FIG. 7, in one or more embodiments, a method for evaluating a cutting arrangement for a drill bit includes: selecting a cutting element arrangement for a drill bit 110; determining a bottomhole hit pattern for the arrangement 112; determining a preferred hit pattern for the arrangement 114; and calculating a score for the arrangement based on a comparison between the bottomhole hit pattern and the preferred hit pattern 116. In this embodiment, determining the characteristic representative of drilling (103 in FIG. 7) can be carried out by numerically calculating (generating) a bottomhole hit pattern 112, and the criterion selected for evaluating this characteristic (105 in FIG. 7) is a preferred hit pattern 114. The score for the arrangement is calculated based on a comparison of the bottomhole hit pattern to the preferred hit pattern.

Figure 9:
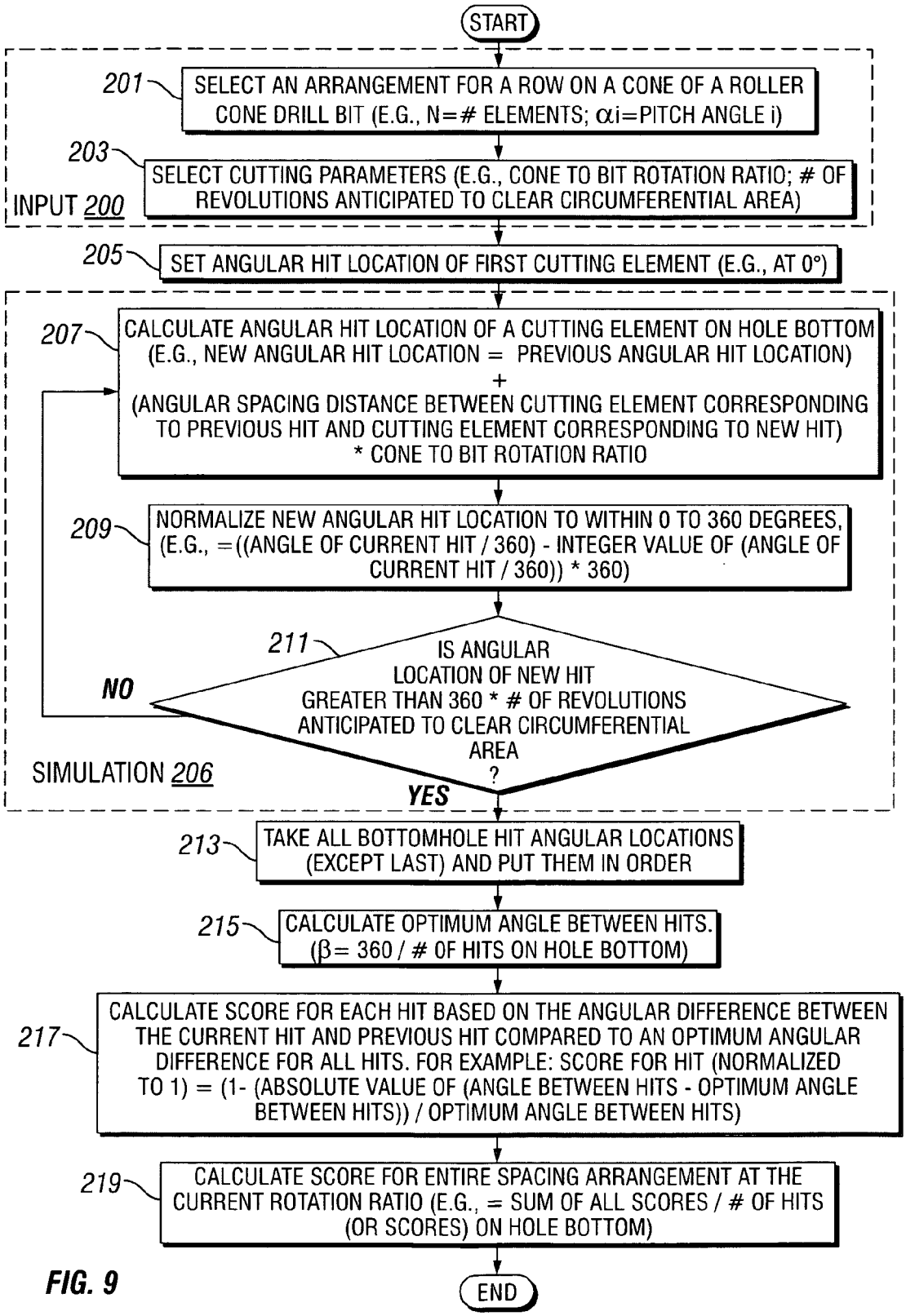
FIG. 9 shows a flow chart of a method in accordance with one embodiment of the invention that may be used to evaluate a cutting efficiency of a cutting element arrangement in a row of a roller cone of a drill bit.

One example in accordance with the exemplary embodiment of the method shown in FIG. 8 is illustrated in FIG. 9. This example is a simplified example specifically configured for evaluating a cutting element arrangement comprising a row of cutting elements on a roller cone of a roller cone drill bit, as discussed above with reference to FIGS. 4, 5, and 6. The calculations in this example may be performed by a computer program, such as a C-program or a program developed using Microsoft® Excel®. Alternatively, these steps may be carried out manually and/or experimentally as determined by a system or bit designer.

Referring now to FIG. 9, in this example, the method starts by selecting or otherwise providing input parameters 200 including an arrangement for cutting elements generally arranged in a row on a roller cone of a roller cone drill bit, 201. As discussed above with reference to the arrangement shown in FIG. 4, this type of arrangement may be defined in terms of the pitch angles between adjacent cutting elements. For example, if the arrangement comprises 10 cutting elements as shown in FIG. 4, it may be defined by the following array of pitch angles:

$$\alpha = \begin{bmatrix} \alpha_1 \\ \vdots \\ \alpha_{10} \end{bmatrix} \qquad \text{Eq. 1}$$

wherein $\alpha_i$ is the pitch angle between cutting element i and cutting element i+1 in the row. For the example arrangement presented in FIG. 4, cutting element 46 is considered the first cutting element in the arrangement and the remaining cutting elements are considered consecutively numbered in a counter clockwise direction about the row.

Referring back to FIG. 9, input parameters 202 may also include other parameters, such as a cone to bit rotation ratio and a number of revolutions of the bit to be considered in the evaluation. Any number of bit revolutions may be evaluated as determined by a bit or system designer. For example, three bit revolutions may be selected for a given arrangement based on an understanding that it would be undesirable for cutting elements to contact approximately the same bottomhole location as a previous cutting element during that limited number of revolutions of the bit. Alternatively, the number revolutions may be determined from a calculation involving bit design parameters. For example, the number of revolutions to be considered may be calculated or estimated using the following equation derived to estimate the number of revolutions required to clear a bottomhole area cut by a row of cutting elements on a roller cone drill bit:

$$R \approx \frac{\text{circumferential area to be cut}}{(\text{crater size}) * (\#\text{ of cutting elements in pattern})} \qquad \text{Eq. 2}$$

wherein R is the number of bit revolutions to be considered.

After the input parameters are provided or otherwise made available, drilling by the bit is simulated 206. In this case, the drilling by the bit is "numerically simulated," that is, calculations are preformed to determine the bottomhole hit pattern for the cutting arrangement if it were placed on a bit and the bit were rotated by the given number of revolutions. For the simplified arrangement considered, bottomhole hit locations are determined by setting a first hit location by a cutting element equal to 0°, 205, and then based on the location of the first hit, calculating the location of each successive hit on the bottomhole as the bit is "rotated", 207 and 209. Using this approach, the calculations for new hit locations are repeated until the given number of revolutions for the bit is reached, 211.

Successive bottomhole hit location can be calculated (at 207) from an assumed first hit location using on the following equation:

$$\beta_{j+1}=\beta_j+\alpha_i*r \qquad \text{Eq. 3}$$

wherein $\alpha_i$ is the pitch angle between the last cutting element that hit the bottomhole and the current cutting element hitting the bottomhole for clockwise rotation of the cone, r is the cone to bit rotation ratio, $\beta_j$ is the angular location of the previous hit on the bottomhole, and $\beta_{j+1}$ is the angular location of the current hit on the bottomhole. The angular locations of bottomhole hits are with respect to the angular location of the first bottomhole hit (for example, 51 in FIG. 5).

In this example, each bottomhole hit location is calculated (at 207) and then normalized to within 0° to 360°, at 209. The bottomhole hit locations may be normalized using the following equation:

$$\beta'_j=\left(\frac{\beta_j}{360}-\text{int}\left(\frac{\beta_j}{360}\right)\right)*360 \qquad \text{Eq. 4}$$

wherein int(x) is the integer value of x, and $\beta'_j$ is the normalized bottomhole hit location.

The bottomhole hit locations are calculated and normalized until the number of revolutions selected is reached, 211. The number of revolutions is reached when the bit has been rotated 360° times the number of revolutions given for the bit. Therefore, calculations for new hit locations will continue until the current bottomhole hit location (before being normalized) is equal to or greater than 360° times the number of revolutions for the bit. This condition may be expressed as follows:

$$\beta_j \geqq 360*R \qquad \text{Eq. 5}$$

wherein R is the selected number of revolutions for the bit.

After calculating all of the bottomhole hit locations for the given number of revolutions, the last hit location calculated is dropped (because it is at or beyond the number of revolutions to be considered). Then the remaining normalized bottomhole hit locations are ordered (e.g., sorted numerically) based on their angular location on the bottomhole, 213. For the simplified arrangement in this example, the normalized and ordered bottomhole hit locations can be expressed as an array of angular locations in ascending order from 0° to 360°. The normalized and ordered bottomhole hit locations will hereafter be referred to as simply "bottomhole hit locations," but the variable $\beta''_j$ will be used in exemplary equations below for clarity to signify that a normalized and ordered hit location is being referenced (See Equation 7).

After the bottomhole hit locations, $\beta''_j$, are determined, a parameter corresponding to a preferred hit pattern is calculated, at 215. In this example, the preferred hit pattern selected is a set of evenly spaced hits, similar to the one shown in FIG. 6. Because the hits in this preferred hit pattern are equally spaced on the bottomhole, the preferred hit pattern can be characterized by a single pitch, which in this case is referred to as the "optimum" angle between adjacent hits. The optimum angle between hits for the selected cutting arrangement can be calculated (at 215) using the following equation:

$$\beta_{opt}=360°/J \qquad \text{Eq. 6}$$

wherein $\beta_{opt}$ is the optimum angular spacing between hits in the preferred hit pattern, and J is the total number of hits on the bottomhole (or the number of hit locations) calculated for the given number of revolutions of the drill bit.

Once the optimum angle between hits is determined (at 215), a score for the arrangement is calculated, 217 and 219. In this example, the score is derived as a numerical representation of the amount of difference between the hit spacing in the bottomhole hit pattern and the hit spacing in the preferred hit pattern. The following equation is an example of an equation that may be used to calculate a score at 217 based on a difference in spacing for a single hit (hereafter referred to as a hit score):

$$s_j=1-\frac{|(\beta''_{j+1}-\beta''_j)-\beta_{opt}|}{\beta_{opt}} \qquad \text{Eq. 7}$$

wherein $s_j$ is the hit score calculated for the placement of the j+1 from the $j^{th}$ hit in the bottomhole hit pattern. A hit score is calculated for the spacing of each successive hit. Then a score for the final space can be calculated based on a difference in spacing between the last hit and the first hit in the bottomhole hit pattern and the last hit and the first hit in the preferred hit pattern. Once a hit score for each hit on the bottomhole is obtained, a total score for the arrangement is then calculated based on the individual hit scores, 219.

Using the hit score equation above, the following equation can be used to obtain a score for the selected arrangement based on the individual hit scores:

$$S=\sum_{1}^{J}\frac{s_j}{J} \qquad \text{Eq. 8}$$

wherein J is the number of hits on the bottomhole, and S is the score for the arrangement at the given ratio. These equations result in a maximum score of 1.

Advantageously, embodiments of the invention in accordance with the method shown in FIG. 8 may used to quantify a cutting efficiency of proposed arrangements for a drill bit based on a comparison of each bottomhole hit pattern determined for each arrangement and a preferred hit pattern selected as the evaluation criterion. In one or more other embodiments of the invention, a cutting arrangement may be selected or defined in any manner known in the art. For example, a cutting element arrangement may be selected from a database of stored cutting arrangements. The cutting element arrangement may be selected by providing coordinates corresponding to locations for each of the cutting elements in the selected arrangement. The cutting element arrangement may be selected by selecting the number of cutting elements desired in the arrangement and the amount of spacing desired between adjacent cutting elements. The amount of spacing between adjacent cutting elements may be selected by running a program that automatically assigns an amount of spacing between each of the adjacent cutting elements based on selected arrangement constraints (i.e., minimum amount of spacing allowable, maximum amount of spacing allowable, and a desired incremental change in spacing). The program may be used to determine all of the different pattern combinations within the defined arrangement constraints so that a score can be calculated for each of the arrangements and an optimized arrangement determined based on the scores.

Additionally, bottomhole hit locations may be determined in a manner different than that presented in the example above. For example, bottomhole hit locations may be determined from geometric calculations known in the art based on a given parameters for a geometry of the drill bit and a given number of bit revolutions. Alternatively, bottomhole hit locations may be obtained experimentally. For example, an experimental simulation may be carried out by rotating a physical model of a bit with the selected cutting arrangement thereon on an earth formation sample. Then the location of each hit made on the sample may be measured and recorded.

Additionally, a preferred hit pattern may be determined in a manner different than that presented in the example above. For example, a preferred hit pattern may be any bottomhole pattern selected as preferred by a bit designer. The preferred hit pattern may be a pattern selected to resemble a bottomhole pattern produced by a bit shown to exhibit favorable drilling characteristics in the field. Alternatively, the preferred hit pattern may be a pattern of equally distributed hits over an area cut by cutting elements in the arrangement for a given number of revolutions of the bit. Alternatively, the bottomhole hit pattern may be a pattern of hits which optimizes the shape or size of uncut sections of formation left on the bottomhole after a number of revolutions of the bit. Additionally, the preferred hit pattern may be described by any parameters as determined by the system designer. The method for defining or selected a preferred hit pattern or preferred hit locations is considered a matter of choice for the system designer or the bit designer, and not a limitation on the invention.

Additionally, preferred hits can correspond to actual hits in any manner determined by a system designer. For example, hits in a preferred hit pattern and a bottomhole hit pattern may be determined to correspond dependent upon which cutting element made the hit and/or during which revolution the hit was made in. This is also considered a matter of choice for the system or bit designer. In view of the above description, numerous other embodiments may be developed in accordance with the invention and used to evaluate cutting element arrangements proposed for a drill bit.

For example, in selected embodiments, the invention may also provide methods that can be used to evaluate a cutting arrangement on a roller cone drill bit over a plurality of cone to bit rotation ratios. This type of evaluation may be desired because in many cases cone to bit rotation ratios typically fluctuate over a range during actual drilling. Because the rotation ratio significantly affects the placement of hits on the bottomhole, a method for evaluating cutting arrangements for bits that can take into account a plurality of different cone to bit rotation ratios may be preferred.

In general, cone to bit rotation ratios expected during drilling may be expressed as an assumed range of ratios, estimated from measurements taken during drilling, estimated from force calculations known in the art, or obtained from a drilling simulation conducted for a bit design. One example of a method that may be used to determine cone to bit rotation ratios expected during drilling is disclosed in U.S. Pat. No. 6,516,293, which is assigned to the assignee of the present invention.

Figure 10:
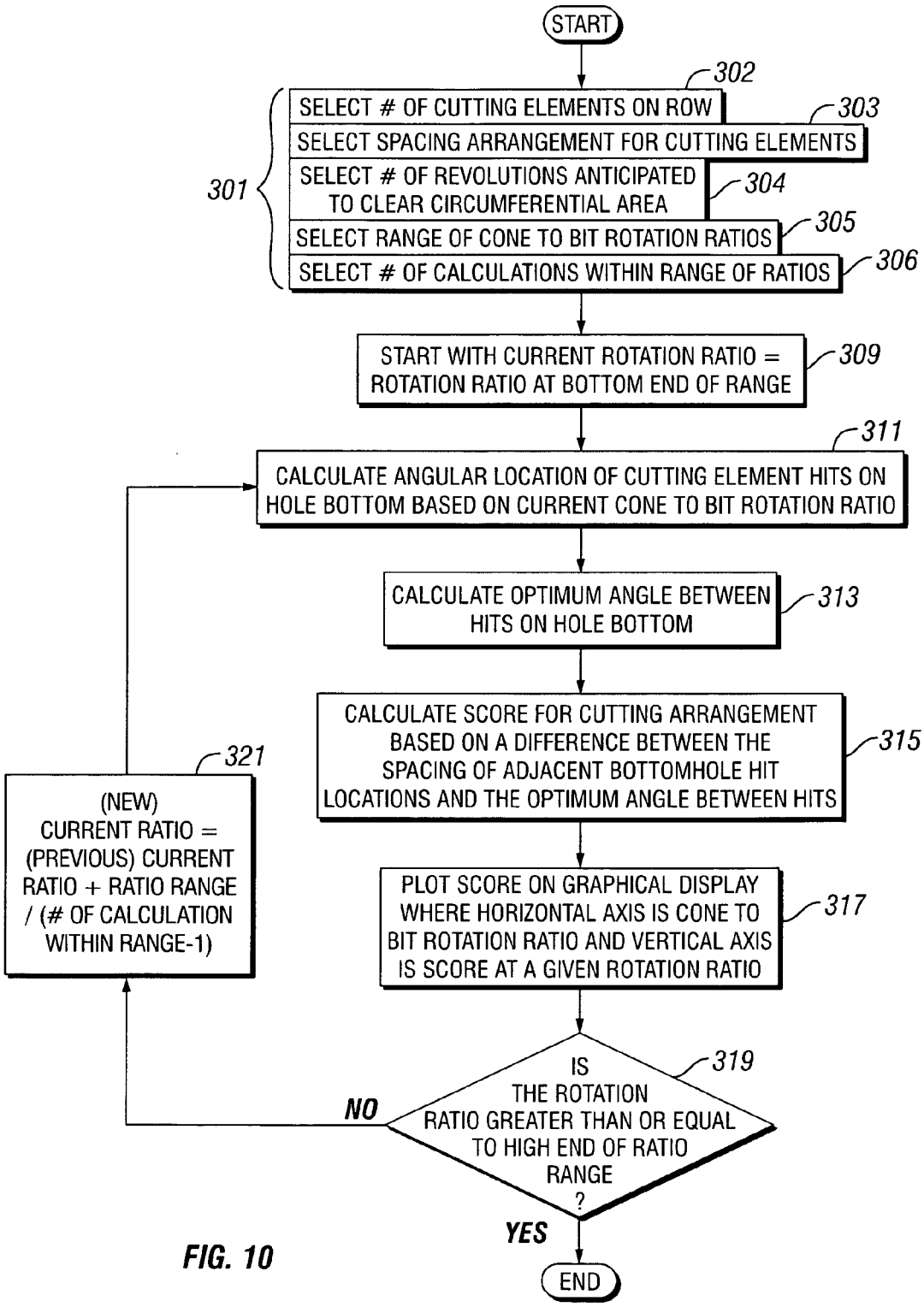
FIG. 10 shows a flow chart of a method in accordance with one embodiment of the invention that may be used to evaluate a cutting efficiency of a cutting element arrangement for a roller cone of a drill bit over a range of cone to bit rotation ratios.

Referring now to FIG. 10, one example of a method which takes into account different rotation ratios expected during drilling is shown. This example is specifically developed for an arrangement comprising a row of cutting elements discussed above with reference to FIG. 4. In this example, the method starts by selecting input parameters 301 including a number of cutting elements for an arrangement on a roller cone bit 302 and a spacing of the cutting elements in the arrangement 303. As stated above, the spacing for a row arrangement on a cone may be defined by an array of pitch angles between adjacent cutting elements in the row on the cone. Additional input parameters include a number of revolutions of the bit to be considered 304, a range of cone to bit rotation ratios to be considered 305, and a number of calculations to be performed within the range of ratios during the evaluation 306.

The range of cone to bit rotation ratios may be provided in terms of a maximum rotation ratio and a minimum rotation ratio within a range. In such case, the number of calculations to be performed within the range can be used to determine the values of the rotation ratios to be considered in the range. In an alternative embodiment, the range of cone to bit rotation ratios may be provided or described in terms of a distribution, such as by a median rotation ratio, a lower 5 percentile ratio, a lower 25 percentile ratio, an upper 5 percentile ratio, and an upper 25 percentile ratio for the range.

After the input parameters are selected or otherwise made available, the method includes setting a current cone to bit rotation ratio equal to a rotation ratio at the bottom of the range 309, and then calculating the bottomhole hit locations for the cutting arrangement at the current rotation ratio 311. The method also includes calculating an optimum angle between hits 313, and based on the difference between the spacing of the bottomhole hit locations and the optimum angle between hits, calculating a score for the selected cutting arrangement 315. A method, such as the one detailed in FIG. 9 and discussed above, may be used to determine the bottomhole hits (311), the optimum angle between hits (313), and the score (315) for the arrangement at the current rotation ratio.

Figure 13:
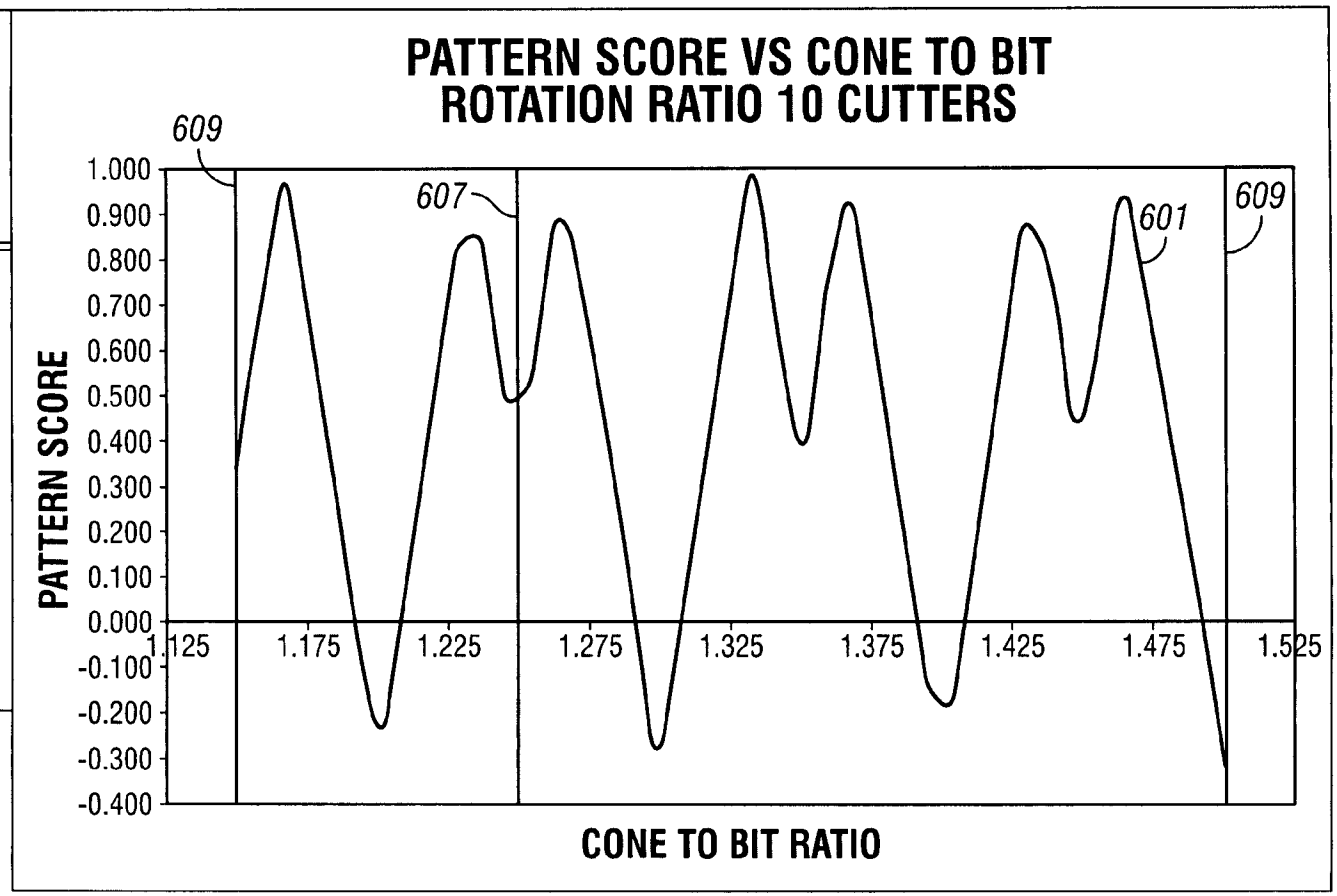
FIG. 13 shows one example of a score obtained for a cutting element arrangement comprising a score curve having a score value corresponding to each rotation ratio within a defined range.

Once the score for the arrangement at the current rotation ratio is obtained, the score can be graphically displayed on a graph generated on a display screen, wherein the horizontal axis is the cone to bit rotation ratios and the vertical axis is the score value calculated for a cutting arrangement 317. One example of this type of graphical display is shown in FIG. 13.

If the current rotation ratio is less than the maximum ratio defined as the high end of the range (checked at step 319), the rotation ratio is then increased by an incremental amount 321 and the "scoring calculations" (steps 311 through 315) are repeated to obtain a new score for the arrangement at the new rotation ratio, and the score for the new rotation ratio is plotted on the graphical display (step 317). The scoring calculations are repeated for each new rotation ratio in the range until the maximum rotation ratio in the range is reached or exceeded (checked at 319). In this example, the incremental increase in the rotation ratio, at 321, after each set of scoring calculations is calculated based on the following equation:

$$\Delta r = \frac{r_{\max} - r_{\min}}{(C-1)} \quad \text{Eq. 9}$$

wherein $r_{max}$ is the maximum rotation ratio in the range, $r_{min}$ is the minimum rotation ratio in the range, and C is the number of calculations to be considered within the range.

Embodiments of the invention similar to the one shown in FIG. 10 will result in a score comprising an array of values wherein each value corresponds to a rotation ratio considered within the selected range. The score can be graphically displayed as described above and shown for example in FIG. 13. The score (or score curve) 601 shown in FIG. 13 was obtained using the method described above for a cutting element arrangement comprising 10 cutting elements in an even pitch pattern (equally spaced over 360°) on a roller cone of a drill bit. The number of revolutions considered during this evaluation was three. The rotation ratios at which calculations were performed are shown below the graph and generally designated as 603.

Figure 11:
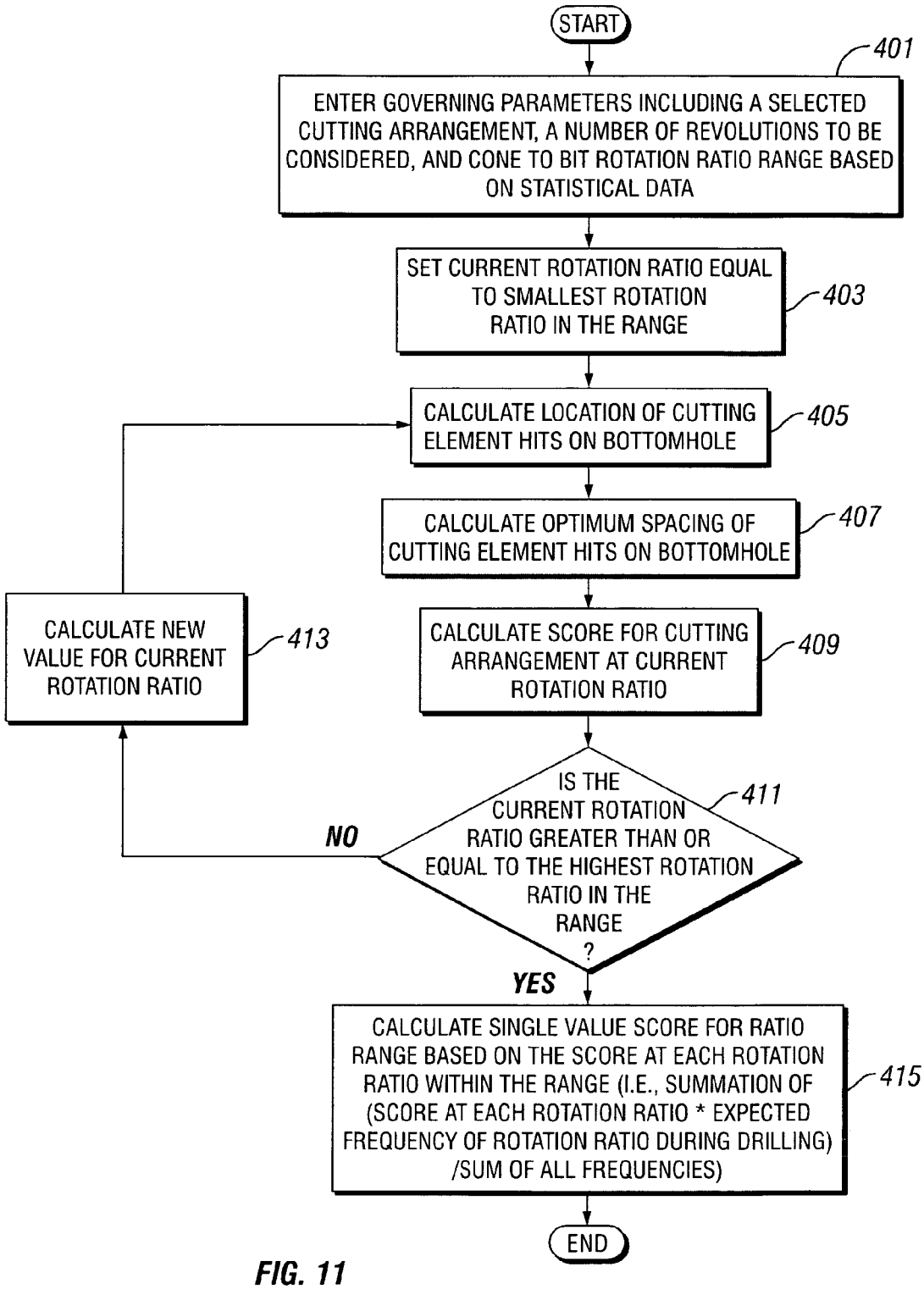
FIG. 11 shows a flow chart of a method in accordance with one embodiment of the invention that may be used to obtain a single value score for a cutting element arrangement for a roller cone of a drill bit over a range of cone to bit rotation ratios.

Another example in accordance with an embodiment of the invention is shown in FIG. 11. In this example, a single value score for a cutting arrangement is obtained. This single value score is reflective of the performance of a cutting arrangement over a range of cone to bit rotation ratios. This example is similar to the example shown in FIG. 10. However, this example includes the additional step of calculating a single value score for the range of rotation ratios based on the score obtained at each rotation ratio considered within the range, 415.

In this embodiment, the method includes entering governing parameters 401 including a selected cutting arrangement, a number of revolutions to be considered, and a cone to bit rotation ratio range based on statistical data. The method also includes setting the current rotation ration equal to the smallest ratio in the range 403 and calculating the location of cutting element hits on the bottom hole 405. The method further includes calculating optimum spacing of cutting element hits on the bottomhole 407 and calculating a score for the cutting element arrangement at the current rotation ratio 409. The calculating is repeated for the arrangement at each rotation ratio considered in the range (through 411 and 413). Then a single score is calculated for the arrangement 415 based on the score calculated at each rotation ratio and an expected frequency of rotation ratio during drilling.

For example, a single value score can be calculated as the average score within a given rage of rotation ratios. This calculation can be expressed as follows:

$$S_R = \sum_{1}^{C} \frac{S_c}{C} \quad \text{Eq. 10}$$

wherein $S_c$ is the score obtained for the $c^{th}$ rotation ratio considered in the range, C is the total number of rotation ratios considered within the range, and $S_R$ is the single value score for the selected range of rotation ratios.

Figure 1:
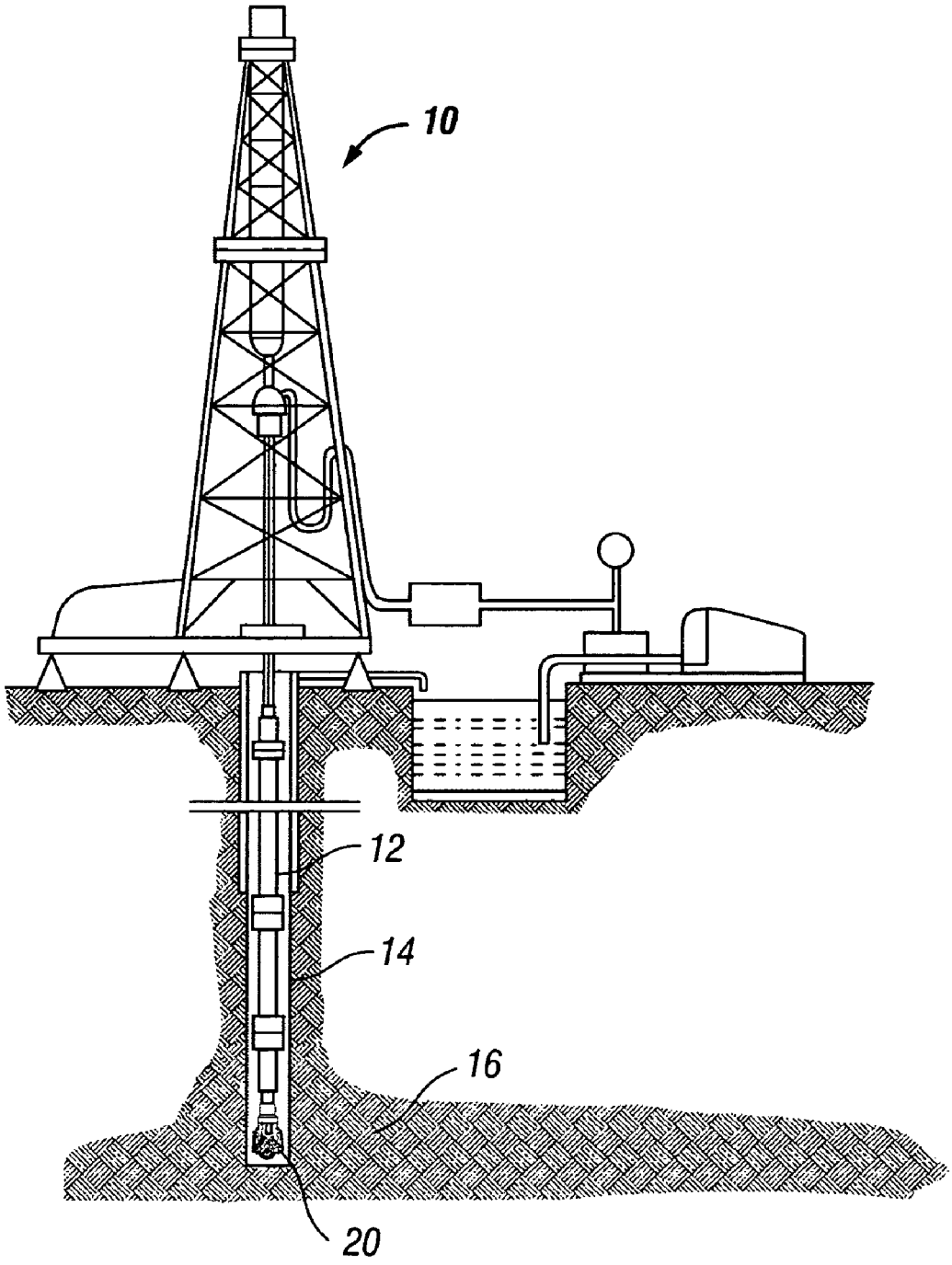
FIG. 1 (Prior Art)
FIG. 1 shows a schematic diagram of one example of a system for drilling well bores in subterranean earth formations.

In one or more embodiments of the invention, statistical information about the rotation ratios considered may be used to obtain a single value score that is considered to be more reflective of drilling performance. This statistical information may be given, approximated, or assumed. For example, given a median rotation ratio, an upper limit ratio, and a lower limit ratio, it may be assumed that during drilling a cone may rotate at a median rotation ratio most often and less often around the outlier rotation ratios near the top and/or bottom of the range. In such case, a weighted single value score can be calculated which takes into account the likelihood or probability of rotation at each rotation ratio within the range. For example, a weighted single value score may be calculated at 413 in FIG. 1, using the following equation:

$$S_R = \sum_{1}^{C} \frac{w_c \cdot S_c}{C} \quad \text{Eq. 11}$$

wherein $S_c$ is the score obtained for the $c^{th}$ rotation ratio considered in the range, $w_c$ is the weighting factor given to the $c^{th}$ rotation ratio, C is a constant equal to the total number of rotation ratios considered within the range, and $S_R$ is the single value score for the selected range of rotation ratios. The weighting factor given to each rotation ratio may be any weighting factor as determined by a system designer.

For example, assuming a generally normal distribution of rotation ratios during drilling, with the median rotation ratio being about halfway between the upper limit and lower limit rotation ratios, an equation can be developed to produce weighting factors between 0 and 1. The weighting factor given to the median rotation ratio may be 1, if it is believed to occur most often. The weighting factor at the far ends of the rotation ratio range may be some small fraction of the weighting factor for the median rotation ratio, if it is understood that the cone will only be turning at these rates some small percentage of the time in comparison to the median ratio. The following equation is one example of an equation that may be derived and used to calculate values for weighting factors for the above equation:

$$w_c = 1 - \left|\left(\frac{(C+1)}{2}\right) - c\right| \cdot \frac{2}{(C-1)} \cdot (1-\xi) \quad \text{Eq. 13}$$

wherein $w_c$ is the weighting factor for the score value obtained for the $c^{th}$ rotation ratio, C is the total number of rotation ratios considered within the range, and $\xi$ is the weighting factor desired for the upper limit and lower limit rotation ratios. This equation was derived to represent a linear approximation of a normal distribution. Use of this equation will result in a weighting factor of 1 for the median rotation ratio and a weighing factor equal to $\xi$ for the upper and lower limit rotation ratios in the range, if the rotation ratios are indexed in ascending or descending order. Weighting factors obtained using the above equation may be normalized so that their sum is equal to 1 (i.e., 100%) by dividing the value of each weighting factor obtained from Equation 13 by (C−1)/2.

In some cases, it may not be desirable to assume that the median rotation ratio is in the middle of the range. For example, if a median were equal to 1.25, and a five percentile value of 1.15 were taken as the lower limit for the range, and a ninety-five percentile value of 1.5 were taken as the upper limit for the range, it may be more desirable to split the range at the median. The sub-range between the lower limit and the median could have a first number (ITL) of rotation ratios calculated and the sub-range between the median and the upper limit could have a second number (ITU) of rotation ratios calculated, wherein the total number of rotation ratios considered in the range would ITL+ITU=C. In such case, the following equation may be derived and used to calculate the weighting factor for the resulting score values for the rotation ratios within the range:

$$w_c = \xi_1 + (1-\xi_1)*\left(1-\left|\frac{c}{ITL}\right|\right), \text{ for } c = 1 \text{ to } ITL \quad \text{Eq. 13a}$$

$$w_c = \xi_2 + (1-\xi_2)*\left(1-\left|\frac{(c-ITL)}{ITU}\right|\right), \text{ for } c = ITL \text{ to } ITU \quad \text{Eq. 13b}$$

wherein $w_c$ is the weighting factor for the score value obtained for the $c^{th}$ rotation ratio, ITL is the number of calculations performed on the lower ratio range, ITU is the number of calculations performed on the upper ratio range, $\xi_1$ is the weighting factor given to the lower limit ratio, $\xi_2$ is the weighting factor given to the upper limit ratio, and c is the calculation index number. Using this set of equations, at the beginning of a loop c=1 and is indexed by 1 for each loop performed, the first equation above is used until c reaches the number of calculations to be performed on the lower rotation ratio range. Once c hits the upper level, the second equation is used and c will again be indexed by 1 per loop until it has been indexed as many times as the number of calculations to be performed.

In another example, a combined score may be calculated in accordance with the following expression, $$S_R = \sum_{1}^{C} S_c * F(r_c) \quad \text{Eq. 14}$$

wherein $S_c$ is the score obtained for the rotation ratio $r_c$, and $F(r_c)$ is the expected frequency of rotation ratio $r_c$ during drilling, which can be expressed as a fractional percentage so that the sum of all frequencies equal 1. Those skilled in the art will appreciate that numerous other equations are known and can be used for obtaining weighted values for data points based on their frequency of occurrence or other statistical information.

Figure 12:
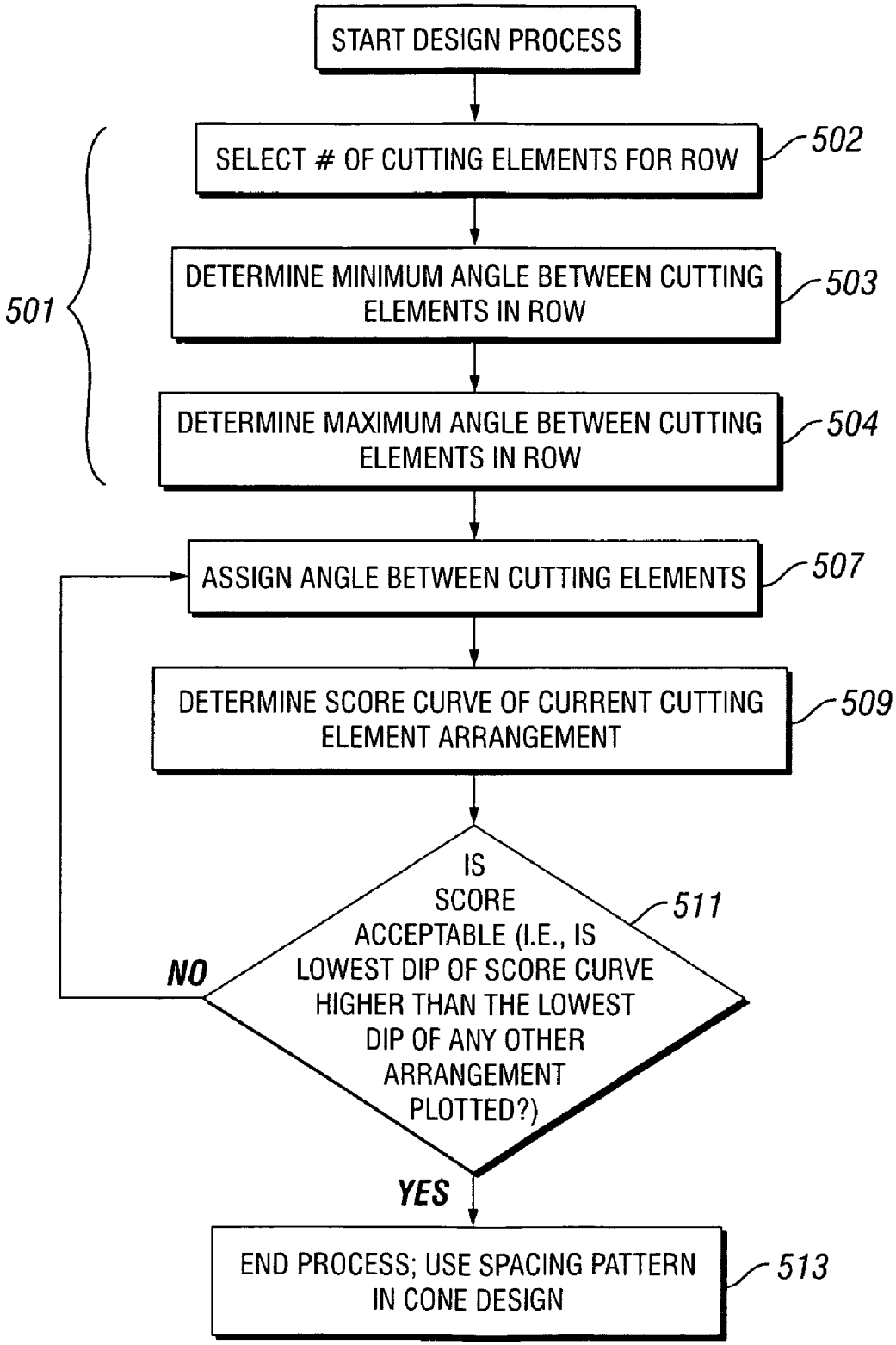
FIG. 12 shows a flow chart of a method for designing a drill bit in accordance with one embodiment of the invention.

The invention also provides a method for optimizing a cutting arrangement. One example of a method in accordance with this aspect of the invention is shown for example in FIG. 12. This example is configured for a cutting arrangement similar to that shown in FIG. 4 and discussed above. This method starts by selecting values for parameters of a cutting element arrangement 501. These parameters include a number of cutting elements for the row 502, a minimum pitch angle allowable between cutting elements in the row 503, and a maximum pitch angle allowable between cutting elements in the row 504. Preferably, the minimum pitch angle is not so small that there is inadequate clearance between bases of adjacent cutting elements. Also, preferably, the maximum pitch angle is not so large that cutting elements in wide gaps are susceptible to breakage.

Once the input parameters are selected or otherwise made available, the method includes assigning a spacing angle between adjacent cutting elements 507. The spacing angles between adjacent cutting elements may be entered manually by a user or automatically assigned by a program based on selected arrangement conditions. In the case of manually selected spacing angles, all of the spacing angles except one may be selected and then the last spacing angle calculated (by subtracting the sum of the other spacing angles from 360°). In the case of automatically assigned spacing angles, spacing angles between cutting elements may be assigned in groups, in which case, the number of groups and the number of spaces within each group may be selected or determined based on set arrangement conditions. For example, the number of spaces in each group may be selected and then all of the spaces in a group automatically set equal to the same value. The spacing angles may be limited to values between a given minimum and maximum, and only angles within half or whole degree increments considered. One or more spaces between groups may be automatically assigned values by subtracting the sum of the angles in all defined groups from 360° and then equally distributing the remaining space between the one or more remaining spaces. Alternatively, the values for these other spaces may be individually assigned.

Once the one or more spacing angles are assigned, at step 507, a score for the current cutting element arrangement is determined 509. A method such as one of the methods shown in FIGS. 9, 10 and 11 and described above, may be used to determine the score for a current cutting element arrangement. Once a score for a cutting element in obtained, the score is checked to determine whether it is an acceptable score 511. If the score is not acceptable, a new spacing arrangement is assigned by adjusting the value of at least two pitch angles between cutting elements. Then a score is calculated for the new arrangement 509 and checked to determine whether it is an acceptable score 511. These "evaluation steps" (507, 509, 511) are iteratively repeated until an acceptable score for an arrangement is obtained. Advantageously, these steps can be carried by a program that automatically runs through a sequence of all possible spacing arrangements based on the selected number of cutting elements in the arrangement and selected spacing conditions.

Once an acceptable score is obtained, the arrangement corresponding to the acceptable score is selected for a drill bit design, 513. If no score is determined to be acceptable during the evaluation, the method may include comparing the scores for each of the arrangements considered during the evaluation and selecting from the arrangements a most favorable arrangement for a drill bit design based on a comparison of the scores. In one or more embodiments, the most favorable arrangement may be selected from a group of arrangements having scores closest to a desired score based on a combination of the score and other characteristics related to the arrangement, such as the difference between the pitches in the arrangement.

In one more embodiments in accordance with this aspect, a score for an arrangement may be considered acceptable if it has a value higher than a selected value. For example, in the case of a single value score, it may be determined to be acceptable if it is equal to or higher than a given value for a preferred score. In the case of a score curve comprising an array of values over a range of rotation ratios, the score may be considered most favorable if its lowest dip (or lowest value over the range) is higher than a particular value or if its lowest dip is higher than a lowest dip (or value) of the scores for the other arrangements considered. Alternatively, a score may be considered more favorable if the average or median score for the range of rotation ratios is higher than a given value or higher than the average or median score for the other arrangements considered. A score (score curve) among favorable scores may be considered more desirable if it also has a low standard deviation or variation within the expected range of rotation ratios.

Figure 14:
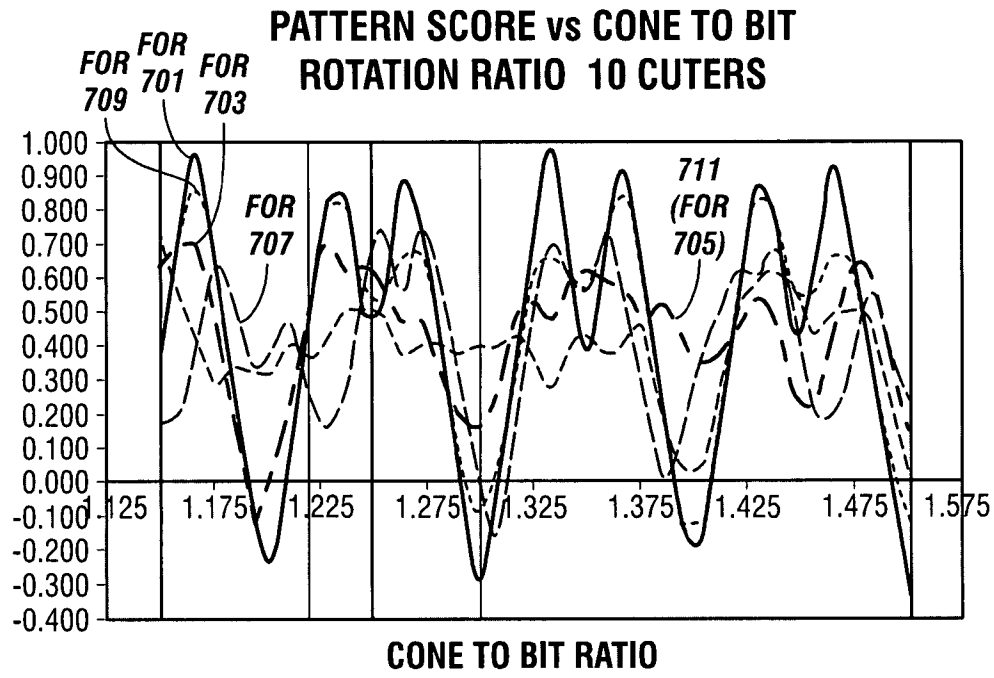
FIG. 14 shows one example of a plurality of score curves, each generated for a different cutting element arrangement for a row of a roller cone drill bit.

For example, FIG. 14 shows an example of several score curves obtained for different pitch patterns proposed for a row of 10 cutting elements on a roller cone of a roller cone drill bit (defined at 701, 703, 705, 707, and 709). The scores were calculated over a range of cone speed to bit speed rotation ratios defined by a median value 713, a low 25 percentile value 715, a high 25 percentile value 717, a low tolerance value 719, and a high tolerance value 721. The score curves obtained for each of the pitch patterns were calculated using a method similar to the method shown on FIG. 10 and described above.

Figure 14A:
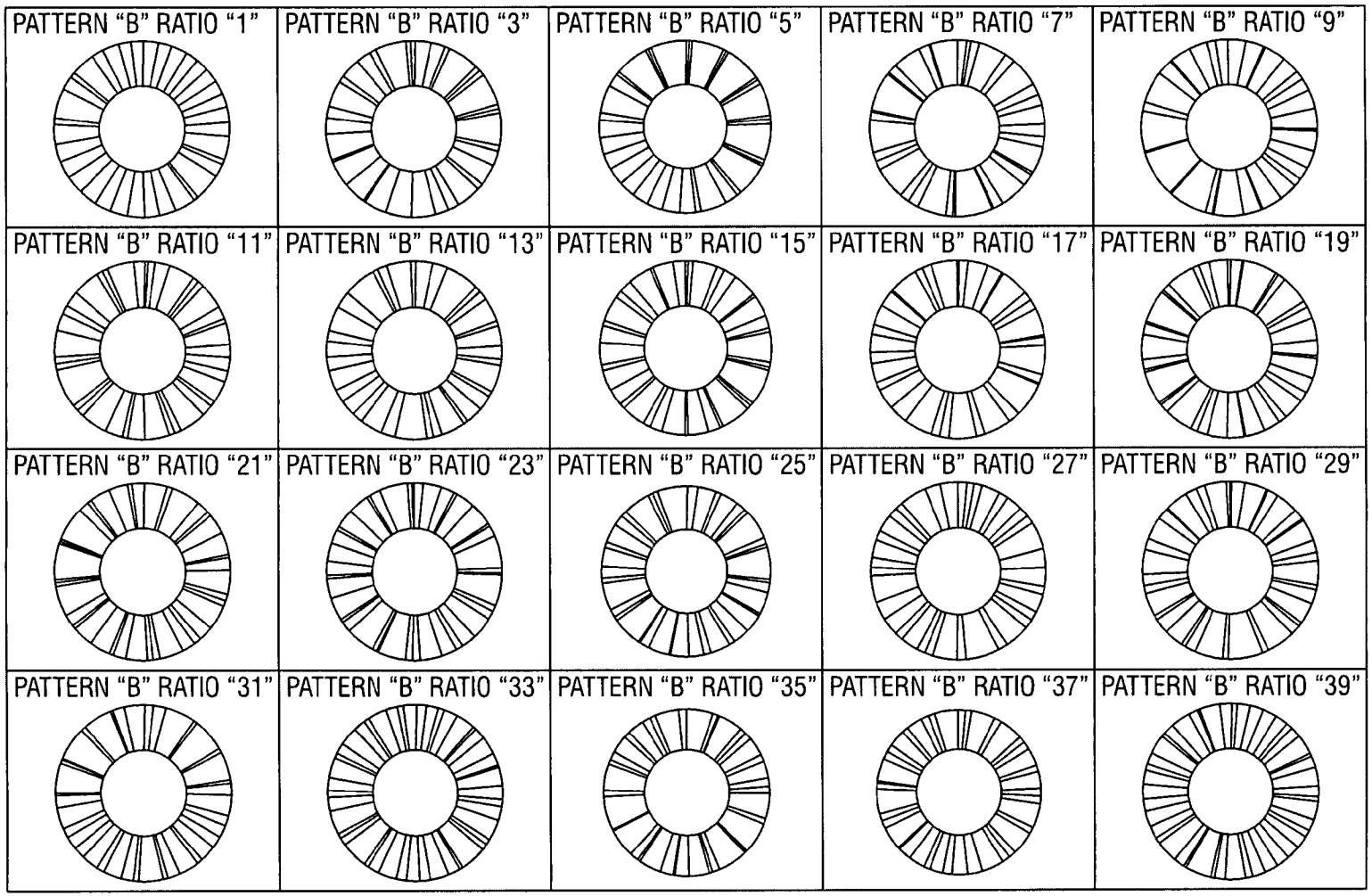
FIG. 14A shows examples of bottomhole hit patterns obtained for 10 cutting elements in a row on one roller cone of a roller cone drill bit arranged in accordance with the pitch pattern B shown in FIG. 14.

In the example shown in FIG. 14, the score curve having a lowest dip that is higher than the lowest dips for any of the other score curves is the score curve 711 obtained for pitch pattern B, 705. This pitch pattern includes a first group of adjacent pitch angles that are all the same and a second group of adjacent pitch angles that are all the same and different from the pitch angle in the first group. Although the value of the score 711 fluctuates over the range of rotation ratios considered (ratio values shown at 723), the corresponding arrangement was found to result in a more equalized distribution of hits on the bottomhole for three revolutions of the bit (indicated at 725) than the other arrangements. Examples of bottomhole hit patterns obtained for pitch pattern B on a row of a roller cone drill bit are shown for each of the selected rotation ratios in FIG. 14A.

Those skilled in the art will appreciate that based on the above description, different factors may be used to determine whether a score is acceptable or preferred depending on the equations used to calculate a score. For example, for a different set of score equations, the score may be considered more desirable if its value is lower than a selected value. Additionally, a cutting arrangement may be selected from among a plurality of different arrangements considered based on a visual comparison of the score curves obtained for the different cutting arrangements. Also, similar embodiments can be adapted for evaluation of fixed cutter bits.

Other embodiments of the invention specific to roller cone drill bits may also be developed wherein the rotation ratio is adjusted during the revolutions of the bit to account for slipping which may occur as the bit is rotated. For example, if a current bottomhole hit location is less than a selected slipping distance away from a previous bottomhole hit location, the current hit may be considered to slip to the previous hit location. In such case, the rotation ratio may be adjusted, such as increased or decreased depending on whether the previous hit location is in front of or behind the current expected hit location. As hit locations are calculated, they may also be adjusted to account for slipping.

Additionally, the cone revolution speed to bit revolution speed may be influenced by the gearing effect a row or rows of cutting elements on a roller cone has upon contact with the bottomhole as weight and torque are applied to the drill string. For example, as the cone rotates there is a continuous change in the geometry (or characteristics of the cutting structure) of the portion of the cone acting upon the hole bottom for every next moment of cone rotation. The geometry of the bottom is also continuously changing as well. Due to the continuous changes in the geometry which makes up this gearing effect, the rotation ratio is continuously changing.

Through the use of computer simulated bit dynamics or actual measurements of the speed of a cone on a bit in actual application, it can be seen that the rotation ratio, although changing, does spin at some speeds more than other speeds. Therefore, the speed may be considered somewhat fixed, or constant, for several revolutions over which the analysis done and the cone to bit rotation ratio can be adjusted to take into account the slipping of a gearing cutter into a crater created by a previous revolution of the cone. In other words, although the rotation ratio may be considered generally constant, the ratio can be allowed to deviate upon such slipping.

For example, if the roller cone is generally rotating at a given speed of 1.21 cone to bit revolutions, and is so upon initial contact with the crater, but then is immediately effected as the cutting element falls or slips into a crater, either backward or forward, depending on the proximity of the cutting element to the crater and the characteristics of the rock at the contact area. So, for that moment the ratio may be considered to be a bit more or less than 1.21, but then is assumed to be constantly 1.21 again until another slipping situation occurs.

Additionally, in one or more embodiments, the adjustment to the current hit location may be a function of how close within the slippage distance the current hit occurred to the previous hit to more accurately account for slipping during drilling. For instance, a hit may be considered to include a crater or impression geometry approximated as a deeper interior section resulting from plastic deformation surrounded by a shallower periphery section resulting from brittle fracture. When a new hit is determined to occur within a deeper section of a previous hit, it can be assumed that the cutting element would slip to the deepest point of the crater, in which case the new hit would be adjusted as equal to the location of the previous hit. When a new hit is considered to occur within a more shallow section of a previous hit, it can be assumed that the cutting element would slip by a small distance closer to the location of the previous hit.

Additionally, in one or more embodiments, a fluctuating rotation ratio may be used during the calculation of a score. For example, the rotation ratio may be considered or known to fluctuate during drilling. This may be known based on results obtained from a simulation of the drill bit or a similar drill bit or based on measurements obtained during drilling. Given a data record of the values of a fluctuating ratio, this data can be used to calculate the location of the hits made on the bottomhole. For example, using the method disclosed in U.S. Pat. No. 6,516,293, which is assigned to the assignee of the present invention, a bottomhole hit pattern may be simulated for three revolutions of a bit, taking into account the fluctuating ratio over the course of the drilling simulated, and this bottomhole pattern can be compared to a preferred hit pattern and a corresponding score calculated as noted above. Alternatively, the exemplary method for calculating the hit locations noted above in Equation 3 can be used to calculate the hit locations, where for a fluctuating ratio, the value of the rotation ratio, r, will fluctuate or change as successive hit locations are calculated to more closely reflect the bottomhole pattern expected during drilling.

Those skilled in the art will appreciate that numerous functions and characteristics may be included in other embodiments of the invention to more closely model characteristics representative of drilling as determined by a system designer without departing from the spirit of the invention.

Also, in accordance with the above aspects of the invention, one embodiment of a method for optimizing a cutting arrangement may includes: (a) selecting an arrangement of cutting elements for the drill bit; (b) determining a bottomhole hit pattern for the arrangement; (c) comparing said bottomhole hit pattern to a preferred hit pattern; (d) adjusting at least one parameter of the arrangement; and (e) repeating steps (b) through (d) until a preferred arrangement having the bottomhole hit pattern similar to the preferred hit pattern is obtained. Advantageously, one or more embodiments of the invention may be used to determine an optimum arrangement for a given drilling criteria, such an arrangement which results in a bottomhole hit pattern which most closely matches a preferred hit pattern.

Advantages of the above described aspects of the invention may include one or more of the following. Advantageously, one or more embodiments of the invention may also be used to quantify a cutting efficiency of a cutting arrangement for a drill bit to allow for a quick and easy comparison of several different cutting arrangements proposed for a drill bit design. One or more embodiments of the invention may also be used to automatically determine an optimum arrangement for cutting elements on a bit without requiring time consuming testing or trial and error manufacturing of test bits. One or more embodiments of the present invention may also provide a set of logical sequences which, for a given set of parameters, can result in an optimum sequence of pitch angles for cutting elements generally arranged in rows on one or more roller cones of a drill bit.

Embodiments of the invention may advantageously be carried out using a computer program which includes logic similar to that described above that systematically analyzes substantially all scenarios of pitches within a given range and outputs a best pitch pattern based on selected criteria. Thus, in one aspect, the present invention relates to a computer system for calculating a score for a drill bit. The computer system includes a processor, a memory, a storage device, and software instructions stored in the memory. The software instruction enable the computer system under control of the processor to accept input related to a cutting element arrangement for a drill bit and calculate a score for the arrangement based on the input and a criterion. The selected criterion may be selected by a user by providing input or selected in software instruction. The software instructions may also repeat the calculations for one or more other arrangements and for one or more rotation ratios for each arrangement (in the case of a roller cone bit) based on user input. The software instruction may generate a display of the scores on a display screen and may also determine, based upon calculated scores for different arrangements, a preferred arrangement for a drill bit.

Figure 15:
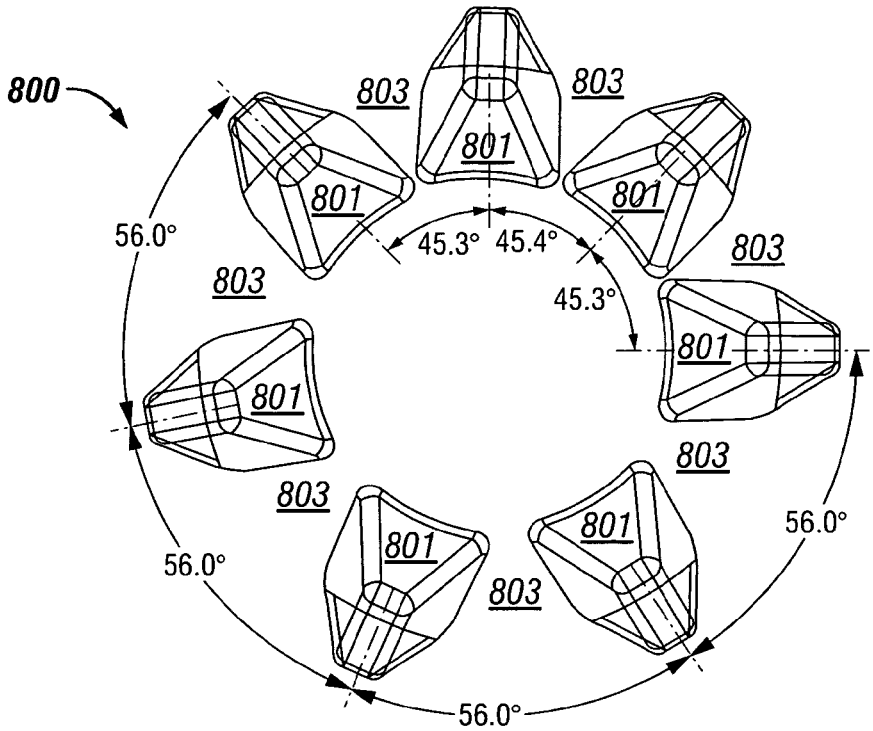
FIG. 15 shows one example of a pitch pattern for a row of a roller cone drill bit in accordance with an aspect of the present invention.
Figure 16:
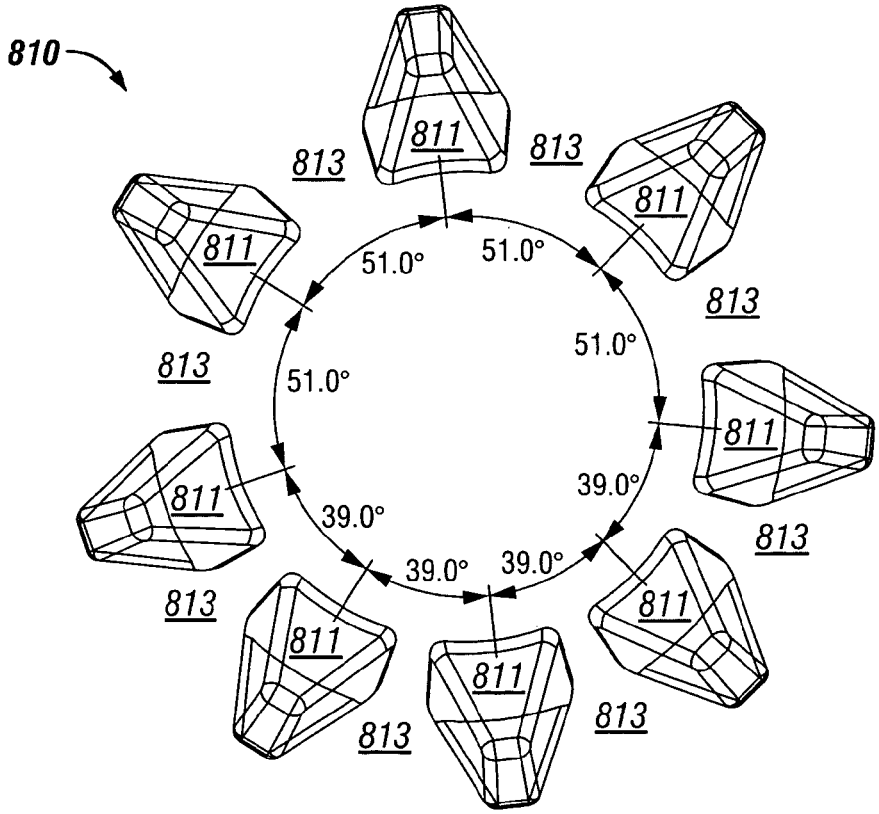
FIG. 16 shows another example of a pitch pattern for a row of a roller cone drill bit in accordance with an aspect of the present invention.
Figure 17:
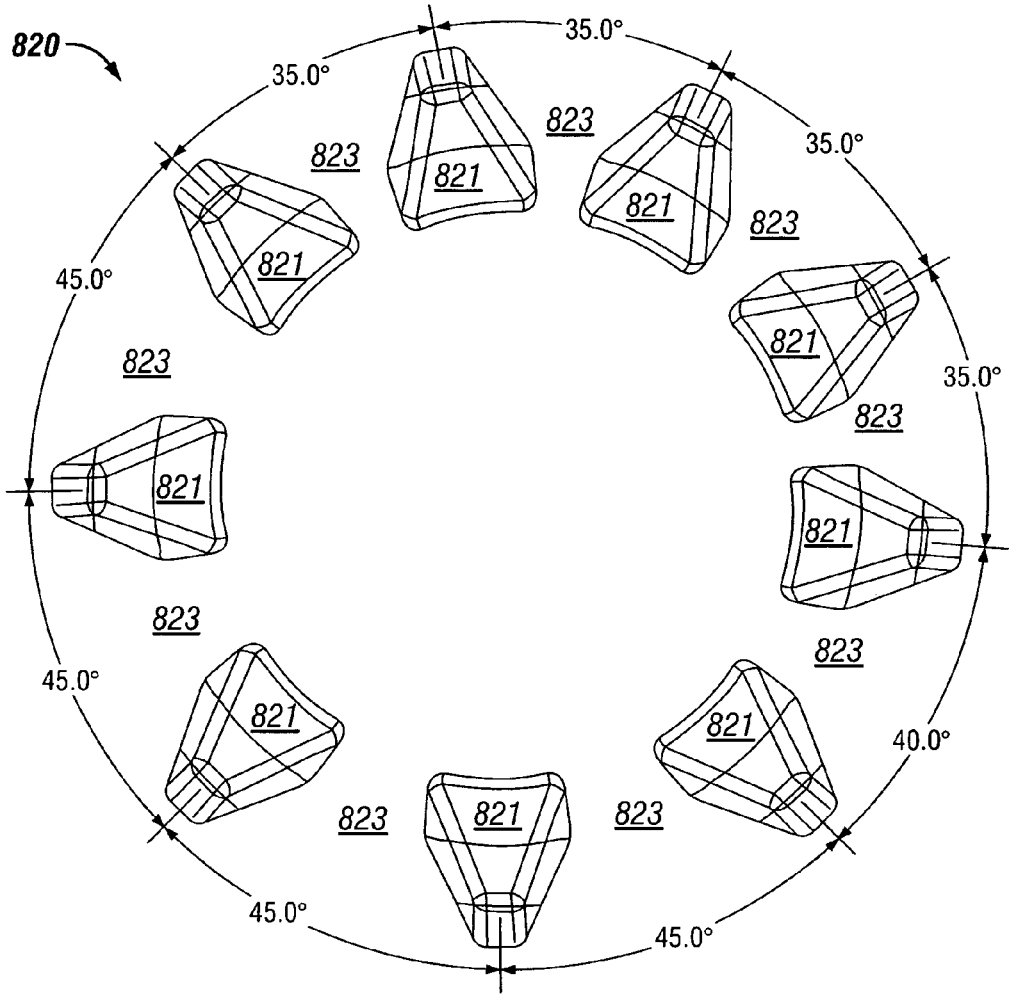
FIG. 17 shows another example of a pitch pattern for a row of a roller cone drill bit in accordance with an aspect of the present invention.

Referring now to FIGS. 15–17, in another aspect, the invention provides roller cone drill bits for drilling earth formations. In one or more embodiments, the cutting elements are arranged on a bit in accordance with a spacing pattern that has been found to result in reduce tracking and slipping in comparison to prior art bits.

In one embodiment in accordance with this aspect, the roller cone drill bit includes a bit body and a plurality of roller cones rotatably attached to the bit body. The bit also includes a plurality of cutting elements generally arranged in a circumferential row on one of the cones with spaces provided between adjacent cutting elements. The spaces between the adjacent cutting elements are arranged in identifiable groups. A first group of spaces includes at least three adjacent spaces which are all substantially equal to a first pitch. A second group of spaces includes at least two adjacent spaces which all substantially equal to a second pitch. The second pitch is substantially different from the first pitch.

Examples of cutting arrangements in accordance with this aspect of the invention are show in FIGS. 15–17. Referring to FIG. 15, the cutting arrangement 800 includes seven cutting elements 801 arranged in a circumferential row with a total of seven spaces 803 provided between adjacent cutting elements in the row. Three adjacent spaces between cutting elements are substantially equal to each other. These spaces are all substantially equal to a first pitch angle, $P_1 \cong 45°$. The other four spaces in the arrangement 800 are all equal to a second pitch angle, $P_2=56°$. The second pitch angle is substantially different than the first pitch angle. In this example, the second pitch angle is approximately 24.4% larger than the first pitch angle.

Another spacing pattern is shown in FIG. 16. In this example, the spacing pattern 810 includes eight cutting elements 811 arranged in a circumferential row with a total of eight spaces 813 provided between adjacent cutting elements. Four of the spaces 813 which are adjacent each other are substantially equal to a first pitch angle, $P_1=39°$. The remaining spaces in the cutting arrangement 810 are all equal to a second pitch angle, $P_2=51°$. In this example, the second pitch angle, $P_2$, is approximately 30.8% larger than the first pitch angle, $P_1$.

Another spacing pattern is shown in FIG. 17. This spacing pattern 820 includes nine cutting elements 821 arranged in a circumferential row with a total of nine spaces 823 provided between adjacent cutting elements. Four of the spaces 823 in this cutting arrangement 820 are all equal to a first pitch angle, $P_1=35°$. Another four of the spaces 823 in this cutting arrangement 820 are also equal to a second pitch angle, $P_2=45°$. The remaining space is disposed in the row between the two groups of spaces and has a third pitch angle, $P_3=40°$. This third pitch angle is different that the first and second pitch angles. In this example, the third pitch angle is a value between the first and the second pitch angles. The second pitch angle, $P_2$, is approximately 28.6% larger than the first pitch angle, $P_1$, the third pitch angle, $P_3$, is approximately 14.3% larger than the first pitch angle, $P_1$, and the second pitch angle, $P_2$, is approximately 12.5% larger than the third pitch angle, $P_3$.

As shown in FIG. 17, in one or more embodiments, the spacing pattern for a row may also include one or more additional spaces having measurement(s) different than the spaces in the first group and the second group. In the arrangement 820 in FIG. 17, a third pitch is provided which is substantially different from a first pitch assigned to the first group of adjacent spaces and a second pitch assigned to the second group of adjacent spaces.

Also, in one or more embodiments, all of the pitches in the first group may be equal to the first pitch measurement and all of the pitches in the second group are equal to the second pitch measurement, as shown in FIGS. 16 and 17. However, in other embodiments, adjacent pitches may be considered substantially the same, and thus considered a pitch within a same group, if their difference is less than 10% with respect to the smallest pitch. For example, FIG. 15 shows a cutting element arrangement 800 wherein adjacent pitches of 45.3° and 45.4° are considered substantially the same and equal to a first pitch of 45°. Although the difference between pitches within a group may differ by as much as 10%, in one or more embodiments, the difference is preferably 5% or less, or more preferably 2% or less, depending on the pitch sizes and the amount of difference between the pitches in different groups.

Additionally, in one or more embodiments, the first pitch and the second pitch differ by at least 10% with respect to the smaller of the first pitch and the second pitch. In some embodiments, the first pitch and the second pitch may differ by 15% or more. In some embodiments, the first pitch and the second pitch differ 20% or more. In one or more embodiments, the difference between the first pitch and the second pitch is less than 100% of the smaller of the two pitches to avoid a design that places significantly larger stresses on one group of cutting elements than on the other since this could result in premature failure of cutting elements on the bit. In some cases, this difference is preferably less than 75%, and more preferably less than 50% depending on the arrangement and the number of cutting elements in the arrangement.

In cases where spaces in a group have a slightly different measurement, the pitch considered representative of the group may be taken as the median pitch or the closest angular value to the median that is a multiple of 5° for cases involving pitch angles greater than or equal to 20°.

In another embodiment, an arrangement comprises a plurality of cutting elements generally arranged in a row on a roller cone with spaces between adjacent cutting elements wherein a group of at least three contiguous spaces have substantially the same pitch and the majority of the other spaces (the spaces not considered as part of that group) being at least 5° smaller than the pitch given to the spaces in the group. In one or more embodiments, the other spaces in the arrangement are at least 8° smaller that the spaces in the group, and in some cases at least 10° smaller, depending on the number of cutting elements or the number of spaces in the row.

In one or more embodiments where spaces between cutting elements are arranged in identifiable groups, one of the groups of spaces includes at least four contiguous spaces. In one or more embodiments, one of the groups includes at least five contiguous spaces.

In one or more embodiments in accordance with this aspect of the invention, a roller cone drill bit includes a bit body and a plurality of roller cones rotatably attached to the bit body. The drill bit also includes at least seven cutting elements generally arranged in a row on one of the cones with spaces between each of the adjacent cutting element in the row. The spaces are arranged such that a first identifiable group of adjacent spaces includes spaces all substantially the same in measurement, and a second identifiable group includes the spaces other than those spaces in the first group. The first group of spaces being at least 10% larger than any of the spaces in the second group. The quantity of the spaces in the first group being at least 25% but not more than 75% of all of the spaces in the row between the adjacent cutting elements. In one embodiment, the quantity of the spaces in the first group may be at least 30%. In a preferred embodiment, the quantity of the spaces in the first group may be at least 35%, and more preferably at least 40%. In one embodiment, the quantity of the spaces in the first group is not more than 70%. In a preferred embodiment, the quantity of the spaces in the first group is not more than 65%, and more preferably not more than 60%.

In one or more of the embodiments, the spacing of the first group is at least 15% larger than any of the spaces in the second group. In a preferred embodiment, the spacing of the first group is at least 20% larger than any of the spaces in the second group.

In one or more embodiments, the cutting elements in the row comprise at least 10 cutting elements. In or more of those embodiments, the cutting elements in the row comprises at least 15 cutting elements.

Those skilled in the art will appreciate that the pitches in a spacing pattern in accordance with one of the descriptions above may be described by angular measurements or based on a distance between the tips of adjacent inserts. Those skilled in the art will also appreciate that the preferred amount of pitch for the spaces arranged as described above may be determined for a given number of cutting elements using one of the methods described above for scoring a cutting arrangement, evaluating a cutting arrangement, designing a bit, and optimizing a cutting arrangement. In those cases, the method may include arrangement constraints, such as the assignment of angles in groups in accordance with one or more of the above embodiments. The number of spaces in each group and/or between groups may be selected as determined by the system or bit designer.

Advantageously embodiments in accordance with this aspect of the invention provide a roller cone drill bit having a cutting arrangement that breaks up the pattern laid down by a previous revolution of the bit. By spacing cutting elements in accordance with this aspect, the probability of tracking for a given row may be reduced. In one or more preferred embodiments, the cutting elements on a drive row, gage row, or heel row of each cone are arranged in accordance with a spacing pattern described above. In one or more embodiments, cutting elements on an inner row previously shown to result in tracking are rearranged in accordance with a spacing pattern as described above, to reduce tracking for that row of the bit. Additionally, in one or more embodiments, the cutting elements on the cones are arranged to intermesh between the cones to provide better coverage of the bottomhole during drilling.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A roller cone drill bit comprising:

a plurality of roller cones; and a plurality of cutting elements spaced apart and generally arranged in at least one row on the conical surface of at least one of said roller cones, adjacent ones of said plurality of cutting elements having spaces therebetween, wherein a first group of contiguous ones of said spaces comprises at least three spaces substantially equal in measurement to one another; and a second group of contiguous ones of said spaces comprises at least two spaces substantially equal in measurement to one another, the measurement of the at least two spaces in said second group being substantially different from the measurement of the at least three spaces in the first group.

2. A roller cone drill bit comprising:

a plurality of roller cones; and a plurality of cutting elements generally arranged in at least one row on at least one of said roller cones, adjacent ones of said plurality of cutting elements having spaces therebetween, wherein a first group of contiguous ones of said spaces comprises at least three spaces substantially equal in measurement to one another; and a second group of contiguous ones of said spaces comprises at least two spaces substantially equal in measurement to one another, the measurement of the at least two spaces in said second group being substantially different from the measurement of the at least three spaces in the first group, and wherein the at least three spaces in the first group are all substantially equal in measurement to a first pitch, the at least two spaces in the second group are all substantially equal in measurement to a second pitch, and the first pitch and the second pitch differ by at least 10% with respect to the smallest of the first pitch and the second pitch.

3. The roller cone drill bit of claim 2, wherein the first pitch and the second pitch differ by at least 15% with respect to the smallest of the first pitch and the second pitch.

4. The roller cone drill bit of claim 2, wherein the first pitch and the second pitch differ by at least 20% with respect to the smallest of the first pitch and the second pitch.

5. The roller cone drill bit of claim 2, wherein the first pitch and the second pitch also differ by 100% or less with respect to the smallest of the first pitch and the second pitch.

6. The roller cone drill bit of claim 2, wherein the first pitch and the second pitch also differ by 75% or less with respect to the smallest of the first pitch and the second pitch.

7. The roller cone drill bit of claim 2, wherein the first pitch and the second pitch also differ by 50% or less with respect to the smallest of the first pitch and the second pitch.

8. The roller cone drill bit of claim 1, wherein said second group comprises at least three spaces.

9. The roller cone drill bit of claim 1, wherein said second group is generally positioned opposite said first group.

10. The roller cone drill bit of claim 1, wherein at least one other group comprising at least one space is disposed at a location between said first group and said second group, said at least one space in said at least one other group having a measurement substantially different from the measurement of each of said at least three spaces in said first group.

11. The roller cone drill bit of claim 1, wherein the at least three spaces in the first group are all equal to a first pitch angle, and the at least two spaces in the second group are all equal to a second pitch angle, and said second pitch angle is substantially different from said first pitch angle.

12. The roller cone drill bit of claim 1, wherein the first group comprises at least four spaces.

13. The roller cone drill bit of claim 1, wherein the first group comprises at least five spaces.

14. The roller cone drill bit of claim 1, wherein the number of spaces in the first group comprises at least 25% but not more than 75% of all of said spaces in said row.

15. The roller cone drill bit of claim 14, wherein the spaces in the first group comprise 60% or less of all of said spaces in said row.

16. A drill bit comprising:

a plurality of cutting elements disposed on at least one rotatable element and generally ranged in a row along the surface of the rotatable element with spaces between adjacent ones of said plurality of cutting elements, said spaces including a first group comprising at least three contiguous spaces each substantially equal in measurement to a first pitch, and a second group comprising at least two contiguous spaces each substantially equal to a second pitch, said first pitch being substantially larger than said second pitch.

17. The drill bit of claim 16, further comprising a third group including at least two contiguous spaces each substantially equal to a third pitch, said third pitch being substantially smaller than said first pitch and different from said second pitch.

18. The drill bit of claim 16, wherein said first pitch comprises a first angular measurement and said second pitch comprises a second angular measurement, the first pitch being greater than the second pitch by at least 5°.

19. The drill bit of claim 18, wherein the first pitch is at least 8° larger than the second pitch.

20. The drill bit of claim 18, wherein the first pitch is larger than the second pitch by at least 10°.

21. A drill bit comprising:

a bit body;

a plurality of rotatable elements attached to the bit body and able to rotate with respect to the bit body; and at least seven cutting elements generally arranged in a row on at least one of the rotatable elements with spaces disposed between adjacent ones of the at least seven cutting elements, the spaces identifiable in at least two groups comprising a first group of contiguous spaces all substantially the same in measurement, and a second group of spaces comprising all spaces other than those spaces in said first group, each of said contiguous spaces in said first group being at least 10% larger than the majority of any spaces is said second group, the quantity of the spaces m the first group being at least 25% but not more than 75% of all of the spaces in said row.

22. The drill bit of claim 21, wherein said at least seven cutting elements comprises at least 10 cutting elements.

23. The drill bit of claim 21, wherein said at least seven cutting elements comprises at least 15 cutting elements.

24. The drill bit of claim 21, wherein the quantity of the spaces in the first group comprises at least 30% of all of the spaces.

25. The drill bit of claim 21, wherein the quantity of the spaces in the first group comprises at least 35% of all of the spaces.

26. The drill bit of claim 21, wherein the quantity of the spaces in the first group comprises at least 40% of all of the spaces.

27. The drill bit of claim 21, wherein the quantity of the spaces in the first group comprises less than 70% of all of the spaces.

28. The drill bit of claim 21, wherein the quantity of the spaces in the first group comprises less than 65% of all of the spaces.

29. The drill bit of claim 21, wherein the quantity of the spaces in the first group comprises less than 60% of all of the spaces.

30. The drill bit of claim 21, wherein the spaces in the first group are at least 15% larger than the majority of the spaces in the second group.

31. The drill bit of claim 21, wherein the spaces in the first group are at least 15% larger than all of the spaces in the second group.

32. The drill bit of claim 21, wherein the spaces in the first group are at least 20% larger than the majority of the spaces in the second group.

33. The drill bit of claim 21, wherein the spaces in the first group are at least 20% larger than all of the spaces in the second group.

34. The drill bit of claim 21, wherein said majority comprises at least 75%.

35. The drill bit of claim 21, wherein said majority comprises at least 51%.

* * * * *